US006635398B1

(12) United States Patent
Komoto et al.

(10) Patent No.: US 6,635,398 B1
(45) Date of Patent: Oct. 21, 2003

(54) DRY TONER, DRY TONER PRODUCTION PROCESS, AND IMAGE FORMING METHOD

(75) Inventors: Keiji Komoto, Numazu (JP); Tsutomu Kukimoto, Yokohama (JP); Tatsuhiko Chiba, Kamakura (JP); Akira Hashimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 09/695,079

(22) Filed: Oct. 25, 2000

(30) Foreign Application Priority Data

Oct. 26, 1999 (JP) ..... 11-304680
Oct. 20, 2000 (JP) ..... 2000-320708
Oct. 20, 2000 (JP) ..... 2000-320709

(51) Int. Cl.[7] ..... G03G 9/087; G03G 9/097

(52) U.S. Cl. ..... 430/108.23; 430/109.3; 430/110.3; 430/111.4; 430/124; 430/125

(58) Field of Search ..... 430/109.3, 110.3, 430/111.4, 108.23, 124, 125, 126, 101, 120

(56) References Cited

U.S. PATENT DOCUMENTS

| | | | | |
|---|---|---|---|---|
| 2,297,691 | A | 10/1942 | Carlson | |
| 3,269,626 | A | 8/1966 | Albrecht | 266/177 |
| 3,788,994 | A | 1/1974 | Wellman et al. | 252/62.1 |
| 4,533,617 | A | 8/1985 | Inoue et al. | |
| 4,657,837 | A | 4/1987 | Morita et al. | |
| 4,664,504 | A | 5/1987 | Oda et al. | 355/15 |
| 4,769,676 | A | 9/1988 | Mukai et al. | 355/15 |
| 5,166,028 | A | 11/1992 | Paine et al. | |
| 5,282,007 | A | 1/1994 | Oshiumi | 355/296 |
| 5,312,704 | A | 5/1994 | Fuller et al. | 430/45 |
| 5,514,763 | A | 5/1996 | Kmiecik-Lawrynowicz et al. | 536/340 |
| 5,571,653 | A | * 11/1996 | Kasuya et al. | 430/109.3 |
| 5,721,433 | A | 2/1998 | Kosaka | 250/573 |

FOREIGN PATENT DOCUMENTS

| | | |
|---|---|---|
| EP | 0529927 | 3/1993 |
| EP | 0757294 | 2/1997 |
| GB | 1414159 | 11/1975 |
| GB | 1477504 | 6/1977 |
| JP | 42-23910 | 11/1967 |
| JP | 43-24748 | 10/1968 |
| JP | 44-9880 | 5/1969 |
| JP | 46-15876 | 4/1971 |
| JP | 48-75032 | 10/1973 |
| JP | 50-44836 | 4/1975 |
| JP | 48-75032 | 10/1977 |
| JP | 56-13945 | 4/1981 |
| JP | 57-493 | 1/1982 |
| JP | 57-37353 | 3/1982 |
| JP | 58-205162 | 11/1983 |
| JP | 58-205163 | 11/1983 |
| JP | 59-061842 | 4/1984 |
| JP | 59-133573 | 7/1984 |
| JP | 61-56352 | 3/1986 |
| JP | 62-203182 | 9/1987 |
| JP | 63-128357 | 5/1988 |
| JP | 63-128358 | 5/1988 |
| JP | 63-128359 | 5/1988 |
| JP | 63-128360 | 5/1988 |
| JP | 63-128361 | 5/1988 |
| JP | 63-128362 | 5/1988 |
| JP | 63-133179 | 6/1988 |
| JP | 63-281168 | 11/1988 |
| JP | 1-20587 | 1/1989 |
| JP | 2-302772 | 12/1990 |
| JP | 4-184358 | 7/1992 |
| JP | 4-276762 | 10/1992 |
| JP | 5-2289 | 1/1993 |
| JP | 5-53482 | 3/1993 |
| JP | 5-61383 | 3/1993 |
| JP | 6-242631 | 9/1994 |
| JP | 7-271096 | 10/1995 |
| JP | 7-301947 | 11/1995 |
| JP | 8-136439 | 5/1996 |
| JP | 8-262795 | 10/1996 |
| JP | 8-286416 | 11/1996 |
| JP | 9-265209 | 10/1997 |
| JP | 10-319628 | * 12/1998 |
| JP | 11-160909 | 6/1999 |

OTHER PUBLICATIONS

Japanese Patent Office Partial Machine–Assisted Translation of JP 10–319628 (Pub 12/98), Including Abstract, Claims, Paragraphs 0001–0092 and 0182–0229.*

Lee, et al., "The Glass Transition Temperatures of Polymers", *Polymer Handbook, 2nd Ed.,* by Wiley—Interscience, pp. III–139 to III–192, (1971).

Japanese Industrial Standard JIS–B–0601 (1982), Ed. 7, Definitions and Designation of Surface Roughness, Translation pp. 1–12, (1983).

* cited by examiner

*Primary Examiner*—Janis L. Dote
(74) *Attorney, Agent, or Firm*—Fitzpatrick, Cella, Harper & Scinto

(57) ABSTRACT

A dry toner has toner particles containing at least a binder resin, a colorant and a wax component and an external additive. The binder resin contains a component derived from a monomer selected from butadiene, isoprene and chloroprene. The toner has a main Tg from 40° C. to 70° C. When specific surface area measured by the BET method in an environment of 23° C. atmospheric temperature and 65% relative humidity is represented by A ($m^2/g$) and specific surface area measured by the BET method in an environment of 50° C. atmospheric temperature and 3% relative humidity is represented by B ($m^2/g$), the toner satisfies the following relationship: $0.8 \leqq A \leqq 4.0$, $0.80 \leqq (B/A) \leqq 1.05$. The toner has a circle-corresponding number-average particle diameter D1 from 2 to 10 $\mu$m, an average circularity from 0.950 to 0.995 and a circularity standard deviation less than 0.040. The toner has a main-peak molecular weight from 2,000 to 100,000 and contains a THF-insoluble matter from 5 to 60% by weight.

31 Claims, 6 Drawing Sheets

DRY TONER, DRY TONER PRODUCTION PROCESS, AND IMAGE FORMING METHOD

BACKGROUND OF THE INVENTION

1. Field of the Invention

This invention relates to a dry toner used in recording processes that utilize electrophotography, electrostatic recording, magnetic recording and toner-jet recording, and an image forming method which employs such a dry toner. More particularly, the present invention relates to a toner used in image-forming apparatus utilizable in copying machines, printers, facsimile machines and plotters, and an image forming method which employs such a toner. The present invention also provides a process for producing the toner.

2. Related Background Art

A number of methods are conventionally known as electrophotography as disclosed in U.S. Pat. No. 2,297,691, Japanese Patent Publications Nos. 42-23910 and 43-24748 and so forth. In general, copied images are obtained by forming an electrostatic latent image on a photosensitive member by utilizing a photoconductive material and by various means, subsequently developing the electrostatic latent image by the use of a dry toner (hereinafter call to "a toner") to form a toner image, transferring the toner image to a transfer medium such as paper or film, followed by fixing by the action of heat, pressure, heat-and-pressure, or solvent vapor.

As methods by which the electrostatic latent image is rendered visible, developing methods such as cascade development, magnetic brush development and pressure development are known in the art. Another method is also known in which, using a magnetic toner and using a rotary sleeve provided with a magnet at the core, the magnetic toner is caused to fly across the sleeve and a photosensitive member by the aid of an electric field.

One-component development systems require no carrier such as glass beads or iron powder required in two-component development systems, and hence can make developing assemblies themselves small-sized and light-weight. Also, since in the two-component development systems the concentration of toner in carrier must be kept constant, a device for detecting toner concentration so as to supply the toner in the desired quantity is required, resulting in a large size and weight for the developing assemblies. In the one-component development system, such a device is not required, and hence the developing assemblies can commonly be made relatively light-weight.

As printers, LED printers or LBP printers are prevailing in the recent market. As a trend of techniques, there is a tendency toward higher resolution. More specifically, those which hitherto have a resolution of 300 or 600 dpi are being replaced by those having a resolution of 1,200 or 2,400 dpi. Accordingly, with such a trend, the developing systems are now required to achieve a high minuteness. Copying machines have also made progress to have higher functions, and hence they trend toward digital systems. In this trend, chiefly employed is a method in which electrostatic latent images are formed by using a laser. Hence, the copying machines also trend toward a high resolution and, like the printers, it has been sought to provide a developing system with higher resolution and higher minuteness.

In order to achieve such higher resolution and higher minuteness, it is required to make toners have a smaller particle diameter. However, making toners have a smaller particle diameter results in a great scattering of the chargeability of toner particles, and how to control it becomes important in order to achieve such an object.

For example, Japanese Patent Application Laid-Open No. 4-276762 discloses a proposal of a toner comprising toner particles produced by polymerization and having an average particle diameter of 3 to 8 $\mu$m to the surfaces of which specific carbon black has been made to adhere. When images are reproduced using such a toner provided on particle surfaces with a material capable of controlling chargeability, the carbon black kept adhering to particle surfaces may, e.g., come off upon paper feed of about 5,000 sheets or more to cause a great variation of charging performance of toner, resulting in an insufficient charging stability.

A proposal for imparting charging stability from the viewpoint of materials is also disclosed in, e.g., Japanese Patent Application Laid-Open No. 6-242631. However, as a result of image evaluation actually made by a method disclosed in this publication, there has proved to be room for further improvement in respect of resolution.

In order to make the charging performance of toner uniform, a method is also employed in which a toner on a toner-carrying member is regulated by a strong force by means of a toner thickness regulation member. Where the toner is regulated by a strong force, the toner tends to deteriorate because of friction to tend to cause a lowering of image quality as images are reproduced on a larger number of sheets.

Accordingly, it becomes necessary to enhance the strength of toner. This can commonly be solved by making binder resin of toner have a higher glass transition temperature or introducing a cross-linking component into the binder resin to enhance modulus of elasticity in the region of temperature not higher than the glass transition temperature of the toner. As the result, however, the fixing temperature at the time of image formation must be set high, or, in the case of heat roller fixing, the pressure applied to the roller must be set a little high. This may cause difficulties such that power consumption increases in accordance with necessary heat energy and roller contamination and wind-around offset may occur very frequently.

In order to lower the fixing temperature on the other hand, a method is available in which the binder resin is made to have a low glass transition temperature or have less cross-linking component. Such a method, however, is not preferable because it may cause the difficulties as stated above or may further cause a lowering of blocking resistance during storage of toners.

Various methods and apparatus are also proposed with regard to processes by which toner images are fixed to sheets such as paper and film. At present, a method most commonly used is a pressure heating method using a heating roller or using a stationary heat-generating heater through a heat-resistant film.

The pressure heating method using a heating roller is a method in which the toner image surface of a fixing target sheet is brought into pressure contact with the surface of a heating roller having a releasability to the toner and the fixing target sheet is passed therethrough under pressure contact. In this method, the heating-roller surface and the toner image on the fixing target sheet come into contact under application of a pressure, and hence a very good thermal efficiency can be achieved when the toner image is fixed onto the fixing target sheet, and rapid fixing can be effected.

In this fixing method, however, the heating-roller surface and the toner image come into contact in a molten state under application of a pressure, and hence part of the toner image may adhere and transfer to the fixing-roller surface, which may again transfer to the subsequent fixing target sheet to tend to contaminate the fixing target sheet, which is what is called an offset phenomenon. Such an offset phenomenon is greatly affected by fixing speed and fixing temperature. Accordingly, it is commonly attempted to set the surface temperature of the fixing roller relatively low in the case of fixing at a low speed and set the surface temperature of the fixing roller relatively high in the case of fixing at a high speed so that the quantity of heat imparted to the toner from the heating roller to fix the toner image can always be controlled at a constant level to keep the offset phenomenon from occurring.

The toner on the fixing target sheet is formed in some layers as toner layers. Hence, especially in a system where the fixing is at a high speed and the fixing roller has a high surface temperature, the uppermost toner layer coming in contact with the heating roller and the lowermost toner layer coming in contact with the fixing target sheet have a great difference in temperature. Hence, when the heating roller has a high surface temperature, the toner at the uppermost layer tends to cause the offset phenomenon (i.e., high-temperature offset), and, when the heating roller has a low surface temperature, the toner at the lowermost layer does not melt sufficiently to tend to cause a phenomenon where the toner does not fix to the fixing target sheet (i.e., low-temperature offset).

As a method for solving such a problem, usually employed in the case of fixing at a high speed is a method in which pressure is set higher at the time of fixing to anchor the toner to the fixing target sheet. This method can make the fixing roller temperature low to a certain extent and enables prevention of the high-temperature offset phenomenon of the uppermost layer. However, since a very great shear force is applied to the toner, the fixing target sheet tends to wind around the fixing roller to cause wind-around offset, or separation marks of separating claws for separating the fixing target sheet from the fixing roller tend to appear on fixed images. Moreover, under existing circumstance, because of a high pressure, fixed images tend to cause image quality deterioration such that line images are crushed at the time of fixing or toner scatters.

In the case of high-speed fixing, it is common to use a toner having a lower melt viscosity, set the heating roller at a lower surface temperature and carry out fixing at a lower pressure than in the case of low-speed fixing to fix toner images while preventing high-temperature offset or wind-around offset from occurring. However, use of such a toner having a low melt viscosity tends to cause the offset phenomenon at high temperature.

Making toners have smaller particle diameter brings about an improvement in resolution or sharpness of images on the one hand, and fixing performance for halftone images formed by toners with small particles diameter lowers on the other hand. This phenomenon is remarkable especially in the high-speed fixing. This is because the toner is laid on halftone areas in a small quantity and the toner transferred to concave areas of the fixing target sheet receives heat in a small quantity from the heating roller, and also because fixing pressure is not well applied to the fixing target sheet at its concave areas where the pressure is blocked at its convex areas. The toner transferred to the convex areas of the fixing target sheet at the halftone areas has a small toner layer thickness, and hence the shear force applied per toner particle is greater in that areas than in solid black areas having a large toner layer thickness, so that the offset phenomenon tends to occur and fixed images with a low image quality tend to be formed.

In order to cope with recent trends toward smaller appratus, higher printing speed and networking, it is effective means to broaden anti-offset region of toners to the low-temperature side to simplify fixing assemblies or to make toners have lower fixing temperature to achieve higher-speed fixing processing.

In order to prevent the offset phenomenon, it is also possible to take means of coping with the matter by processing the heating roller surface with a material having a good releasability such as a fluorine resin or by coating the heating roller surface with a release agent such as silicone oil. However, the system where silicone oil is coated is not preferable because it not only requires a large fixing assembly, resulting in a high cost, but also has a complicated structure to tend to cause troubles.

Japanese Patent Publication No. 57-493 and Japanese Patent Applications Laid-Open Nos. 50-44836 and 57-37353 disclose methods in which resins are made asymmetric and cross-linkable to prevent the offset phenomenon, but no sufficient improvement has been made on fixing temperature.

In general, minimum fixing temperature lies between a low-temperature offset temperature and a high-temperature offset temperature, and hence serviceable temperature region lies between the minimum fixing temperature and the high-temperature offset temperature. Service fixing temperature can be made low and also the serviceable temperature region can be broadened by making the minimum fixing temperature as low as possible and making the high-temperature offset temperature (temperature at which high-temperature offset occurs) as high as possible. This enables achievement of energy saving and high-speed fixing and prevention of paper curl. Accordingly, it is always sought to provide a toner having good fixing performance and anti-offset properties.

Under such circumstances, Japanese Patent Application Laid-Open No. 9-265209 discloses that fixing temperature region can be broadened by a toner obtained using as a chief component a resin composition for toner which contains i) 100 parts by weight of a vinyl polymer composed chiefly of a low-molecular weight vinyl polymer component having a weight-average molecular weight of from 3,000 to 10,000 and a high-molecular weight vinyl polymer component having a weight-average molecular weight of from 300,000 to 1,000,000 and ii) from 0.05 to 1 part by weight of an antioxidant, and by melt-kneading this composition, followed by cooling and then fine pulverization. In this method, however, the fixing region is only shifted to the low-temperature side and there is a high possibility that the offset seriously occur on the high-temperature side.

Meanwhile, Japanese Patent Application Laid-Open No. 8-262795 discloses a proposal of a toner obtained using a binder resin comprised of a high-molecular weight styrene-acrylic resin having, in its molecular-weight distribution as measured by gel permeation chromatography, a molecular-weight peak in the region of molecular weight of 500,000 or more, a styrene-acrylic resin having a molecular-weight peak in the region of molecular weight of from 50,000 to 500,000, a styrene-acrylic resin having a cross-linked structure and a polyester resin having a molecular-weight peak in the region of molecular weight of 50,000 or less. This toner, however, is still not well adaptable to high-speed fixing.

Techniques are also proposed in which a capsule toner constituted of a core material and a shell so provided as to cover the surface of this core material is used to improve low-temperature fixing performance. Among them, it is reported that fixing can be effected by pressure only, when a low-melting point wax readily undergoing plastic deformation is used as the core material (U.S. Pat. No. 3,269,626, Japanese Patent Publications Nos. 46-15876 and 44-9880 and Japanese Patent Applications Laid-Open Nos. 48-75032 and 48-75033). However, the toner has a poor fixing roller strength and can be used only for limited purposes. Also, when a liquid material is used as the core material and where shells have a low strength, though fixable by pressure only, capsules may break in a developing assembly to contaminate the interior of a machine. Where shells have a high strength, a great pressure is required to break capsules to bring about too glossy images. Thus, it is difficult to adjust the strength of shells.

Accordingly, a capsule toner for heat roller fixing is proposed in which a resin having a low glass transition point which may cause blocking at the time of high temperature when used alone as a core material but brings about an improvement in fixing strength is used for heat-and-pressure fixing and, as shells, high-melting point resin walls have been formed by interfacial polymerization in order to impart blocking resistance (Japanese Patent Application Laid-Open No. 61-56352). However, since the wall material has a high melting point and also too tough to break easily, the performance of the core material has not completely been brought out.

Japanese Patent Application Laid-Open No. 8-286416 also discloses a technique in which an unsaturated polyester resin or a styrene-acrylic resin is adsorbed and polymerized onto toner particles obtained by suspension polymerization of a mixture of polymerizable monomers, to coat the latter with the former. This technique makes it possible to obtain a toner having very good running performance and also more improved than the above toner in respect of fixing performance, but there has been room for further improvement in respect of low-temperature fixing performance.

Capsule toners for heat roller fixing are also proposed in which under the same idea the core material has been improved in fixing strength (Japanese Patent Application Laid-Open Nos. 58-205162, 58-205163, 63-128357, 63-128358, 63-128359, 63-128360, 63-128361 and 63-128362). However, the toners are produced by spray drying and hence a burden is imposed to production equipment. Also, these take no measure for shell materials and hence the performance of the core material has not completely been brought out.

Japanese Patent Application Laid-Open No. 63-281168 also disclose a capsule toner whose shell material is a thermotropic liquid-crystal polyester, and Japanese Patent Application Laid-Open No. 4-184358 disclose a capsule toner whose shell material is a liquid-crystal polyester. In both the toners, however, the polyester is not amorphous and hence, though the resin melts sharply, energy necessary for melting is required in a large quantity and also the core material has so high a glass transition temperature as to provide a poor fixing performance.

Thus, capsule toners produced using various materials and production process are proposed, but none of them have satisfied all of sufficient low-temperature fixing performance, anti-offset properties and blocking resistance and stress resistance in developing assemblies. Especially with regard to physical properties of capsule toners that can satisfy these performances, no quantitative values have ever been elucidated.

Meanwhile, in a capsule toner disclosed in Japanese Patent Application Laid-Open No. 7-301947, specified are an extent of deformation of toner capsules under application of a load within the range of given weights in a microcompression tester and a change in degree of agglomeration before and after leaving with heating. However, with such features alone, any deterioration of toner in the process of development is not taken into account, and the toner could never be satisfactory in practice.

From the viewpoint of materials, a toner is proposed in which storage elastic modulus of a thermoplastic elastomer at 200° C. is specified (Japanese Patent Application Laid-Open No. 7-271096). However, its effect is emphasized on the improvement in anti-offset properties and the prevention of paper from winding around the heating roller, and is still insufficient in respect of image quality.

As toners making use of general-purpose materials polyene compounds such as butadiene and isoprene, Japanese Patent Application Laid-Open No. 7-271096 discloses an example. Its effect, however, is only to improve anti-offset properties and prevent paper from winding around the heating roller.

For the reasons as stated above, although it is sought to provide in fixing processes a toner having a broad fixing temperature region and superior anti-offset properties, any toners that satisfy these points well and also satisfy high resolution and high minuteness and good charging stability are not available under existing circumstances.

With regard to processes for producing toners, Japanese Patent Application Laid-Open No. 11-160909 discloses a process comprising the step of subjecting a polymerizable monomer composition to suspension polymerization in the presence of an oil-soluble polymerization initiator until polymerization conversion comes to be in the range of from 30 to 97%, followed by addition of a water-soluble polymerization initiator to effect further polymerization. In this process, however, a macromonomer is used, which is not comparable to usual monomers in respect of reactivity, thus the process is unsatisfactory for obtaining toners having good running performance.

Meanwhile, where toner images formed on a photosensitive member in the step of development are transferred to a transfer medium in the step of transfer and in that course a transfer residual toner remains on the photosensitive member, it is necessary for the transfer residual toner to be removed in the step of cleaning and be stored in a waste toner container. In the cleaning step, blade cleaning, fur-brush cleaning, roller cleaning and so forth are conventionally used. In any methods, the transfer residual toner is mechanically scraped off or blocked up with a suitable member and collected into the waste toner container. Accordingly, problems arise because of the fact that such a member is brought into contact with the photosensitive member surface. For example, when a toner that may remain in a large quantity after transfer is used, it is necessary for the member to be strongly brought into contact with the photosensitive member surface, so that the photosensitive member wears to have a short lifetime.

From the viewpoint of apparatus, equipment of such a cleaning assembly necessarily makes apparatus large in size, providing an obstacle to an aim at making apparatus compact. Moreover, in a sense of effective utilization of toners from the viewpoint of ecology, it is desirous to use a system that produces no waste toner.

Here, techniques concerned with "cleanerless" are disclosed in Japanese Patent Applications Laid-Open Nos. 59-133573, 62-203182, 63-133179, 64-20587, 2-302772, 5-2289, 5-53482, 5-61383 and so forth. These, however, do not refer to any desired constitution of toner.

Incidentally, in cleaning-at-development construction having substantially no cleaning assembly, the photosensitive member surface is rubbed with a toner and a toner-carrying member to collect toner present at non-image areas by means of the toner-carrying member and to develop image areas by means of the toner. Such construction is required. At the time of this rubbing, reverse-charged toner called transfer residual toner or fogging toner can electrically be collected with ease if its polarity can readily be reversed. For that end, it can be one means to add a polar component to the toner.

Namely, a common phenomenon is utilized such that most toners containing polar components are speedily chargeable. However, when a release agent having little polarity such as polyethylene or polypropylene is added in order to improve anti-offset properties of toner, the toner can be less speedily chargeable to inhibit smooth collection of toner on the photosensitive member in the developing step. As the result, formed are printed images whose regions having no image originally are imagewise contaminated by toner, i.e., what is called ghost images.

Thus, in the cleaning-at-development construction, a technique is sought which can achieve both fixing performance of toner and image charcteristics. Also, the technique to collect toner at the developing step can be said to be very important also in a system where members are weakly pressed against the photosensitive member for making it have a long lifetime.

SUMMARY OF THE INVENTION

An object of the present invention is to provide a dry toner having solved the problems discussed above.

Another object of the present invention is to provide a dry toner having a superior charging stability.

Still another object of the present invention is to provide a dry toner that can obtain highly minute images in a high resolution and has superior fixing performance and anti-offset properties.

A further object of the present invention is to provide a toner that can enjoy stable formation of high-quality images over a long period of time.

A still further object of the present invention is to provide a dry toner that enables its high-grade application in electrophotographic processes without adversely affecting photosensitive members, toner-carrying members and also even intermediate transfer members, and to provide a process for producing such a dry toner and an image-forming method making use of such a dry toner.

A still further object of the present invention is to provide an image-forming method for electrophotography by which, in a contact development type image-forming process having cleanerless construction or making use of an intermediate transfer member, resolution and transfer performance can be improved while maintaining fixing performance, any ghost images can be kept from occurring on account of an improvement in toner collection performance, and also even running performance can greatly be improved.

To achieve the above objects, the present invention provides a dry toner comprising toner particles containing at least a binder resin, a colorant and a wax component, and an external additive, wherein;

(1) the binder resin contains a component derived from a monomer selected from the group consisting of butadiene, isoprene and chloroprene;

(2) the toner has a main glass transition temperature (Tg) of from 40° C. to 70° C. as measured by differential scanning calorimetry (DSC);

(3) where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$), the toner satisfies the following relationship:

$$0.8 \leqq A \leqq 4.0,\ 0.80 \leqq (B/A) \leqq 1.05;$$

(4) in a toner's number-based circle-corresponding diameter/circularity scatter diagram as measured with a flow type particle image analyzer, the toner has a circle-corresponding number-average particle diameter D1 of from 2 $\mu$m to 10 $\mu$m and has an average circularity of from 0.950 to 0.995 and a circularity standard deviation of less than 0.040; and (5) the toner has, in its molecular-weight distribution of tetrahydrofuran(THF)-soluble matter as measured by gel permeation chromatography (GPC), a main-peak molecular weight in the region of from 2,000 to 100,000 and contains a THF-insoluble matter in an amount of from 5% by weight to 60% by weight.

The present invention also provides a process for producing a dry toner, comprising dispersing a polymerizable monomer composition in an aqueous medium to effect granulation, followed by polymerization in the aqueous medium to form toner particles; the polymerizable monomer composition comprising a binder resin which contains a component derived from a monomer selected from the group consisting of butadiene, isoprene and chloroprene, a polymerizable vinyl monomer, a colorant, a wax and a polymerization initiator;

the polymerization initiator being a radical polymerization initiator, and a radical polymerization initiator being further added when the conversion of polymerization reaction is in the range of from 10% by weight to 95% by weight.

The present invention still also provides an image forming method comprising;

a charging step of applying a voltage to a charging member to charge an electrostatic latent image bearing member;

an electrostatic latent image forming step of forming an electrostatic latent image on the electrostatic latent image bearing member thus charged;

a developing step of bringing a toner carried on a toner-carrying member into adhesion to the electrostatic latent image formed on the electrostatic latent image bearing member, to form a toner image on the electrostatic latent image bearing member;

a transfer step of electrostatically transferring the toner image formed on the electrostatic latent image bearing member, to a transfer medium via, or not via, an intermediate transfer member; and a fixing step of fixing the toner image transferred electrostatically to the transfer medium;

the toner being a dry toner comprising toner particles containing at least a binder resin, a colorant and a wax component, and an external additive, wherein;

(1) the binder resin contains a component derived from a monomer selected from the group consisting of butadiene, isoprene and chloroprene;

(2) the toner has a main glass transition temperature (Tg) of from 40° C. to 70° C. as measured by differential scanning calorimetry (DSC);

(3) where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$), the toner satisfies the following relationship:

$$0.8 \leqq A \leqq 4.0,\ 0.80 \leqq (B/A) \leqq 1.05;$$

(4) in a toner's number-based circle-corresponding diameter/circularity scatter diagram as measured with a flow type particle image analyzer, the toner has a circle-corresponding number-average particle diameter D1 of from 2 μm to 10 μm and has an average circularity of from 0.950 to 0.995 and a circularity standard deviation of less than 0.040; and (5) the toner has, in its molecular-weight distribution of tetrahydrofuran(THF)-soluble matter as measured by gel permeation chromatography (GPC), a main-peak molecular weight in the region of from 2,000 to 100,000 and contains a THF-insoluble matter in an amount of from 5% by weight to 60% by weight.

DESCRIPTION OF THE PREFERRED EMBODIMENTS

Figure 1:
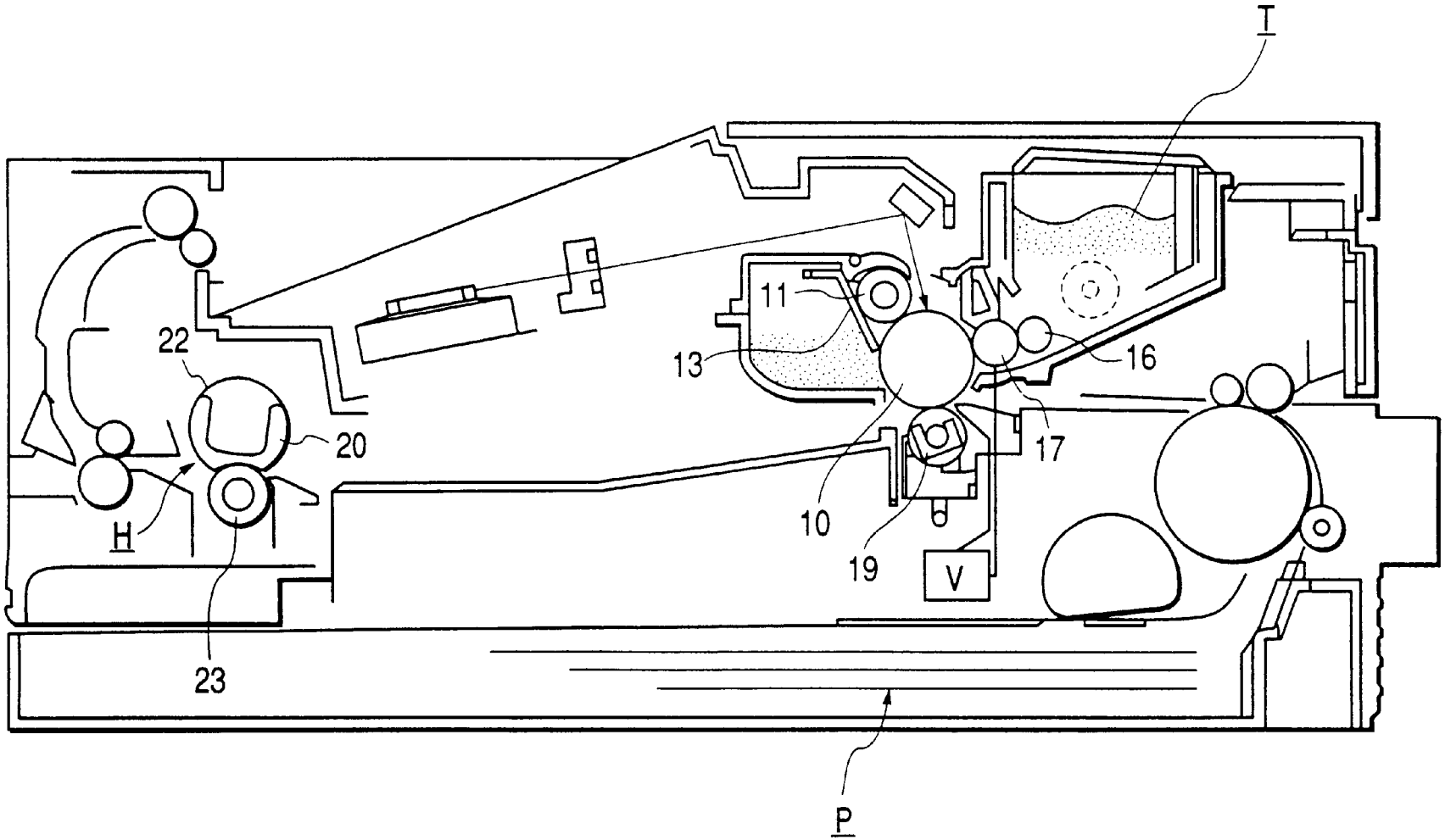
FIG. 1 schematically illustrates the construction of an example of image-forming apparatus to which the image-forming method of the present invention is applicable.

The present invention will be described below in detail.

1. Dry Toner of the Present Invention

The dry toner (hereinafter called "a toner") of the present invention has toner particles containing at least a binder resin, a colorant and a wax component, and an external additive.

The binder resin in the present invention contains a component derived from a monomer selected from the group consisting of butadiene, isoprene and chloroprene (hereinafter often "diene monomer(s)").

In any of the above diene monomers, no oxygen atom is present. Hence, there is no site which may absorb water in air, so that any leak of electric charges may hardly occur in the toner. Thus, any humidity may less affect charge quantity, so that the toner can have a stable charging performance. Moreover, the diene monomer has in one molecule two double bonds which are radically polymerizable, and can have a three-dimensional structure with ease. Hence, e.g., it can contribute to the effect of increasing viscosity and the formation of a network structure. Thus, it can improve the state of presence of materials (semi-)solved or dispersed in the toner particles, such as a pigment and a charge control agent, and further can improve tints of toners, as so presumed. Where monomers such as styrene and its hydrogenated monomer vinylcyclohexane, the former effect attributable to the absence of oxygen atoms is obtainable, but the latter effect attributable to the possession of two double bonds in one molecule is obtainable with difficulty because of the properties of the monomers. Also, in the case of monomers such as divinylbenzene, the reaction of moieties on both sides of the double bonds in one molecule brings about cross-linking because of the benzene ring having a rigid structure, so that any flexibility between cross-linked points of a polymer may be lost to adversely affect the fixing performance or come to have a high brittleness. For the reasons as stated above, the diene monomer is used in the present invention as an essential constituent component.

In addition to the foregoing, any of the butadiene, chloroprene and isoprene have boiling points of −4.4° C., 59.4° C. and 34.1° C., respectively, and are highly volatile at normal pressure. Hence, there is a high possibility that the diene monomer volatilizes during polymerization if it is directly introduced when the diene monomer is introduced into a toner to be produced by suspension polymerization described later. Accordingly, it is preferable to carry out suspension polymerization under application of a pressure or to produce a resin in advance by other means and add the diene monomer to it. The latter is preferred in order to introduce the diene monomer quantitatively into the toner.

The resin containing the diene monomer may preferably be subjected to solution polymerization, emulsion polymerization or soap-free polymerization.

The resin containing the diene monomer, used in suspension polymerization may be a resin polymerized in the presence of a polymerization initiator having a carboxyl group or a sulfuric acid group. Such a resin may also preferably be used. The reason therefor is that the diene-monomer-containing resin can localize with ease in the vicinity of the surfaces of toner particles obtained under incorporation of a polar group in the polymer, and the three-dimensional structure thus taken brings about the effect of improving running performance.

In the present invention, the component derived from butadiene, isoprene and/or chloroprene contained in the binder resin may preferably be in a content of from 0.1 to 20% by weight in total, based on the weight of the toner.

Toners are commonly designed for toner's viscoelasticity by using in combination as binder resins a high-molecular weight resin or cross-linking resin having, in its molecular-weight distribution of THF-soluble matter as measured by GPC, a peak molecular weight of as high as more than 500,000 and a low-molecular weight resin having, in its molecular-weight distribution of THF-soluble matter as measured by GPC, a peak molecular weight of about 1,000 to 50,000. If, however, the diene monomer in the above binder resin is in a content more than 20% by weight, it may be difficult to produce toners designed in such a way, bringing about a problem in some cases. Accordingly, the diene monomer may preferably in a content not more than 20% by weight, and more preferably in the range of from 0.1 to 10% by weight, in the toner. If the diene monomer in the binder resin is in a content less than 0.1% by weight, the stabilization of charging which is the effect aimed in the present invention may insufficiently be achievable and any images with high resolution and high minuteness are not obtainable in some cases.

The content of the diene monomer contained in the toner of the present invention may be measured by, but not particularly limited to, thermal decomposition gas chromatography and mass spectrometry in combination, or by, in further combination therewith, elementary analysis or any other measuring method. It is also possible to estimate the quality of diene monomer component by determining by $^{1}$H-NMR or $^{13}$C-NMR the quantity of the diene monomer contained in THF-soluble matter in the toner.

As monomers constituting the binder resin in the present invention, there are no particular limitations thereon as long as the binder resin contains the monomer selected from the group consisting of butadiene, isoprene and chloroprene. As the other monomers that may constitute the binder resin may include, e.g., styrene monomers such as styrene, o-, m- or p-methylstyrene, and m- or p-ethylstyrene; acrylate or methacrylate monomers such as methyl acrylate or methacrylate, ethyl acrylate or methacrylate, n-propyl acrylate or methacrylate, isopropyl acrylate or methacrylate, n-butyl acrylate or methacrylate, isobutyl acrylate or methacrylate, t-butyl acrylate or methacrylate, pentyl acrylate or methacrylate, hexyl acrylate or methacrylate, cyclohexyl acrylate or methacrylate, 2-ethylhexyl acrylate or methacrylate, adamantyl acrylate or methacrylate, dodecyl acrylate or methacrylate, stearyl acrylate or methacrylate, behenyl acrylate or methacrylate, isobornyl acrylate or methacrylate, dimethylaminoethyl acrylate or methacrylate, and diethylaminoethyl acrylate or methacrylate; maleate monomers such as dimethyl maleate and diethyl maleate; vinyl ether monomers such as ethyl vinyl ether and cyclohexyl vinyl ether; and monomers such as acrylic or methacrylic acid, maleic acid, fumaric acid, maleic anhydride, cyclohexene, acrylo- or methacrylonitrile, and acrylic acid amide; any of which may preferably be used. Any of these may be used alone or in combination of two or more types.

Of these, styrene monomers such as styrene and styrene derivatives are preferred because they can well contribute to the charging stability of the toner when polymerized with the diehe monomer. As the binder resin in the present invention, preferred is a copolymer of any of the above styrene monomers with the diene monomer, in particular, a copolymer thereof with butadiene.

The resin containing the diene monomer as an essential component (hereinafter called "diene-monomer-containing resin") used as the binder resin in the present invention may be modified with epoxy, maleic anhydride, maleic (half) ester and/or a methacrylic acid derivative.

As the binder resin in the present invention, it is also possible to further use block copolymers of the above diene-monomer-containing resin with polystyrene, styrene-acrylic or methacrylic copolymer, or commonly available polyester, polyurethane, epoxy resin, polyolefin, polyamide, polysulfone, polycyanoaryl ether or polyarylene sulfide; or graft-modified copolymers obtained by grafting the diene-monomer-containing resin with an alkyl acrylate or methacrylate, acrylic or methacrylic acid, maleic acid or a styrene monomer.

In the present invention, other resin may also be used in combination with the diene-monomer-containing resin. Such other resin usable in combination with the diene-monomer-containing resin may include various resins commonly used, such as styrene-acrylic resins, polyester resins and epoxy resins.

These resins can be obtained by any of monomers shown below. As specific monomers, they may include styrene monomers such as styrene, o-, m- or p-methylstyrene, and m- or p-ethylstyrene; acrylate or methacrylate monomers such as methyl acrylate or methacrylate, ethyl acrylate or methacrylate, n-propyl acrylate or methacrylate, isopropyl acrylate or methacrylate, n-butyl acrylate or methacrylate, isobutyl acrylate or methacrylate, t-butyl acrylate or methacrylate, pentyl acrylate or methacrylate, hexyl acrylate or methacrylate, cyclohexyl acrylate or methacrylate, 2-ethylhexyl acrylate or methacrylate, adamantyl acrylate or methacrylate, dodecyl acrylate or methacrylate, stearyl acrylate or methacrylate, behenyl acrylate or methacrylate, isobornyl acrylate or methacrylate, dimethylaminoethyl acrylate or methacrylate, and diethylaminoethyl acrylate or methacrylate; maleate monomers such as dimethyl maleate and diethyl maleate; vinyl ether monomers such as ethyl vinyl ether and cyclohexyl vinyl ether; and monomers such as acrylic or methacrylic acid, maleic acid, fumaric acid, maleic anhydride, butadiene, isoprene, cyclohexene, acrylo- or methacrylonitrile, and acrylic acid amide. Any of these may be used alone or in combination of two or more types.

In the present invention, the resin used in combination with the diene-monomer-containing resin may preferably be contained in the binder resin in an amount of from 50 to 99.9% by weight, more preferably from 80 to 99.9% by weight, still more preferably from 85 to 99.5% by weight, and particularly preferably from 85 to 98% by weight. As the type of the resin, styrene-acrylic resins are preferred.

The resin used in combination with the diene-monomer-containing resin may be used alone or in the form of an appropriate mixture of monomers so mixed that the theoretical glass transition temperature (Tg) ranges from 40 to 75° C. To control the theoretical glass transition temperature (Tg) as described, a method is available which is described in a publication POLYMER HANDBOOK, 2nd Edition, III pp.139–192 (John Wiley & Sons, Inc.). In the case when other resin is used in combination, too, the above monomer may likewise be used alone or in the form of an appropriate mixture of monomers so mixed that the theoretical glass transition temperature (Tg) ranges from 40 to 75° C.

If the theoretical glass transition temperature is lower than 40° C., problems may arise in respect of storage stability or running stability of the toner. If on the other hand it is higher than 75° C., the fixing point of the toner may become higher. Especially in the case of color toners for forming full-color images, too high Tg is not preferable because individual color toners may have a poor color-mixing performance at the time of fixing, resulting in a poor color reproducibility and also resulting in a low transparency of OHP images.

The toner of the present invention contains, in addition to the binder resin described above, a colorant and a wax component.

In the toner of the present invention, for the purpose of improving releasability at the time of heat roll fixing, a wax component used as a release agent including hydrocarbon compounds, higher fatty acids, higher alcohols and derivatives of these may preferably be mixed in the toner. Such a wax component may specifically include paraffin wax and derivatives thereof, microcrystalline wax and derivatives thereof, Fischer-Tropsch wax and derivatives thereof, polyolefin wax and derivatives thereof, carnauba wax and derivatives thereof, alcohols, fatty acids, acid amides, esters, ketones, hardened caster oil and derivatives thereof, vegetable waxes, animal waxes, mineral waxes and petrolatum. The derivatives include oxides, block copolymers with vinyl monomers, and graft modified products.

Any of these wax components may be used alone, or in combination of two or more types without any difficulty.

The wax component has a maximum endothermic peak within the temperature range of from 40 to 130° C. at the time of temperature rise, in the DSC curve as measured with a differential scanning calorimeter. The component having a maximum endothermic peak within the above temperature range greatly contributes to low-temperature fixing and also effectively exhibits releasability. If the maximum endothermic peak is at a temperature lower than 40° C., the wax component may have a weak self-cohesive force, resulting in poor high-temperature anti-offset properties and also an excessively high gloss.

If on the other hand the maximum endothermic peak is at a temperature higher than 130° C., fixing temperature may become higher and also it may be difficult to appropriately smoothen fixed-image surfaces. Hence, especially when used in color toners, this is not preferable because of a lowering of color mixing performance. Also, in the case when the toner is directly obtained by polymerization by carrying out granulation and polymerization in an aqueous medium, problems may occur undesirably such that the wax component may precipitate during granulation if the maximum endothermic peak is at a high temperature.

The maximum endothermic peak temperature of the wax component is measured according to ASTM D3418-8. For the measurement, for example, DSC-7, manufactured by Perkin-Elmer Corporation is used. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

In the present invention, any of these wax components may preferably be added in an amount of, but not particularly limited to, from 0.5 to 30% by weight based on the weight of the toner.

As the colorant used in the present invention, conventionally known inorganic or organic dyes and pigments are usable, which may include yellow colorants, magenta colorants and cyan colorants shown below.

Carbon black, aniline black, acetylene black, magnetic materials, calcined pigments, and colorants toned in black by the use of yellow, magenta and cyan colorants shown below may be used as black colorants.

When the carbon black is used in the present invention, it may preferably have a primary particle diameter of from 25 to 80 nm. With regard to particle diameter of the carbon black, if it is smaller than 25 nm, primary particles may be too fine to attain sufficient dispersion with ease and are difficult to handle well. If it is larger than 80 nm, even in a well dispersed state, difficulties may occur such that only images with a low density may be obtained or the toner is consumed in a large quantity, because of an insufficient coloring power as a toner. Further with regard to particle diameter, the carbon black may more preferably have a primary particle diameter of from 35 to 70 nm. This enables the charge polarity and charge quantity of transfer residual toner to be more surely and uniformly controlled by a charging member, and is more advantageous in view of the stability of charge quantity of toner and the coloring power of toner.

The toner of the present invention may also be incorporated with a magnetic material so that it can be used as a magnetic toner. In such a case, the magnetic material usable in the present invention may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

As magnetic materials used in the present invention, surface-modified magnetic materials may also preferably be used. Especially when used in polymerization toners, it is preferable to use materials having been subjected to hydrophobic treatment with a surface modifier having no polymerization inhibitory action. Such a surface modifier may include, e.g., silane coupling agents and titanium coupling agents.

As these magnetic materials, those having an average particle diameter of 2 $\mu$m or smaller, and preferably from 0.1 to 0.5 $\mu$m, may also preferably be used. Any magnetic material may be contained in the toner particles in an amount of from 20 to 200 parts by weight, and particularly preferably from 40 to 150 parts by weight, based on 100 parts by weight of the binder resin.

As the magnetic material, it is preferable to use those having a coercive force (Hc) of from 1,580 to 23,700 A/m (20 to 300 oersted), a saturation magnetization ($\sigma s$) of from 50 to 200 $Am^2/kg$ (emu/g) and a residual magnetization ($\sigma r$) of from 2 to 20 $Am^2/kg$ (emu/g), as magnetic characteristics under application of 796 kA/m (10 kilo-oersteds).

As yellow colorants, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As magenta colorants, condensation azo compounds, diketopyrolopyyrole compounds, anthraquinone compounds, quinacridone compounds, basic dye lake compounds, naphthol compounds, benzimidazolone compounds, thioindigo compounds and perylene compounds are used. Stated specifically, e.g., C.I. Pigment Red 2, 3, 5, 6, 7, 26, 48:2, 48:3, 48:4, 57:1, 81:1, 144, 146, 166, 169, 177, 184, 185, 202, 206, 220, 221 and 254 are particularly preferably used.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 are particularly preferred.

An of these colorants may be used alone, in the form of a mixture, or in the state of a solid solution. The colorants are selected taking account of hue angle, chroma, brightness, weatherability, transparency on OHP films and dispersibility in toner particles. The colorant may preferably be added in an amount of from 1 to 20 parts by weight based on 100 parts by weight of the binder resin.

In the case when a magnetic material is used as the black colorant,the colorant may preferably be added in an amount, as being different from other colorants, of from 40 to 150 parts by weight based on 100 parts by weight of the binder resin.

The toner of the present invention may contain a charge control agent. Any known charge control agent may be used as the charge control agent to be used. In particular, charge control agents which have a high charging speed and also can stably maintain a constant charge quantity is preferred. Also, in the case when the toner particles are directly produced by polymerization, it is preferable to use charge control agents having a low polymerization inhibitory action and substantially free of any solubilizate to the aqueous dispersion medium. As specific compound, they may include, as negative charge control agents, metal compounds of aromatic carboxylic acids such as salicylic acid, naphthoic acid and dicarboxylic acid, polymer type compounds having sulfonic acid or carboxylic acid in the side chain, boron compounds, urea compounds, silicon compounds, and carixarene. As positive charge control agents, they may include quaternary ammonium salts, polymer type compounds having such a quaternary ammonium salt in the side chain, guanidine compounds, and imidazole compounds. The charge control agent may preferably be used in an amount of from 0.5 to 10 parts by weight based on 100 parts by weight of the binder resin.

In the present invention, however, the addition of the charge control agent is not essential. In the case when two-component development is employed, the triboelectric charging with a carrier may be utilized. In the case when non-magnetic one-component blade-coating development is employed, the triboelectric charging with a blade member may positively be utilized.

Where the charge control agent is used in the toner of the present invention, compounds represented by the following Formula (I) are preferred among the foregoing.

Formula (I)

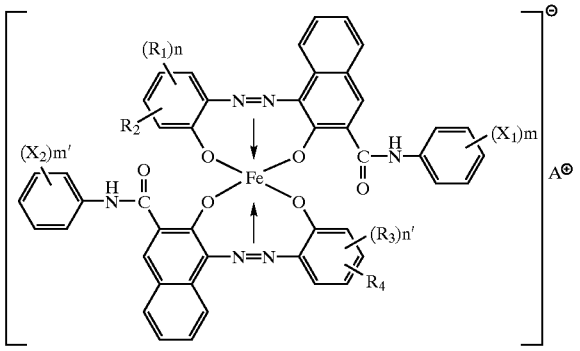

wherein $X_1$ and $X_2$ each represent a hydrogen atom, a lower alkyl group, a lower alkoxy group, a nitro group or a halogen atom, $X_1$ and $X_2$ may be the same or different, and m and m' each represent an integer of 1 to 3; $R_1$ and $R_3$ each represent a hydrogen atom, an alkyl group having 1 to 18 carbon atoms, an alkenyl group having 1 to 18 carbon atoms, a sulfonamide group, a mesyl group, a sulfonyl group, a hydroxyl group, an alkoxyl group having 1 to 18 carbon atoms, an acetylamino group, a benzoylamino group, a halogen atom or —$COOR_5$, $R_1$ and $R_3$ may be the same or different, and n and n' each represent an integer of 1 to 3; $R_2$ and $R_4$ each represent a hydrogen atom or a nitro group; $R_5$ represent an alkyl group or an aryl group; and $A^+$ represents a hydrogen ion, a sodium ion, a potassium ion or an ammonium ion.

The lower alkyl group represented by $X_1$ and $X_2$ may include alkyl groups having 1 to 10 carbon atoms, such as a methyl group, an ethyl group and a propyl group. The lower alkoxyl group represented by $X_1$ and $X_2$ may include alkoxyl groups having 1 to 10 carbon atoms, such as a methoxyl group, an ethoxyl group and a propoxyl group.

The halogen atom represented by $X_1$, $X_2$, $R_1$ and $R_3$ may include fluorine, bromine, chlorine and iodine.

Preferred groups represented by $X_1$ and $X_2$ are hydrogen atoms or nitro groups.

The alkyl group having 1 to 18 carbon atoms, represented by $R_1$ and $R_3$, may include a methyl group, an ethyl group, a propyl group, a butyl group, a pentyl group and a hexyl group.

The alkenyl group having 1 to 18 carbon atoms, represented by $R_1$ and $R_3$, may include a vinyl group, an allyl group, a propenyl group and a butenyl group.

The alkoxyl group having 1 to 18 carbon atoms, represented by $R_1$ and $R_3$, may include a methoxyl group, an ethoxyl group, a propioxyl group and a butoxyl group.

The groups represented by $R_1$ and $R_3$ may also be groups represented by —$COOR_5$. In such a case, the group represented by $R_5$ may include a methyl group, an ethyl group, a propyl group, a phenyl group and a naphthyl group.

Of these, preferred groups represented by $R_1$ and $R_3$ are chlorine atoms.

Preferred groups represented by $R_2$ and $R_4$ are hydrogen atoms.

As preferred specific examples of the above charge control agents, they may include compounds represented by the following Formulas (II) and (III).

Formula (II)

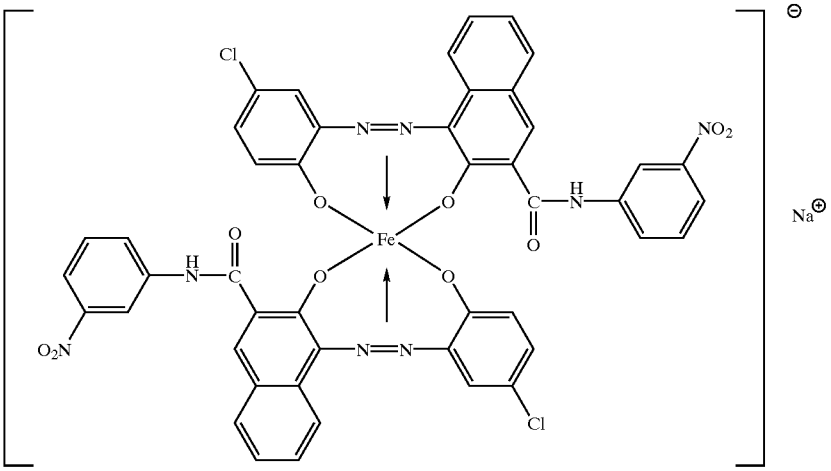

Formula (III)

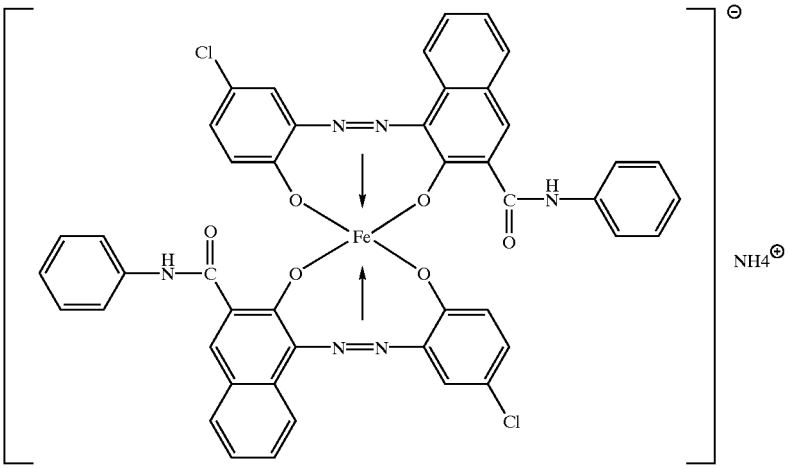

The charge control agent may preferably be used in an amount of from 0.1 to 10 parts by weight, and more preferably from 0.1 to 5 parts by weight, based on 100 parts by weight of the binder resin.

In the toner of the present invention, in order to improve charge stability, developing performance, fluidity and running performance, an external additive may preferably be mixed with the toner particles.

Such an external additive usable in the present invention may first include inorganic fine powder. It may specifically include fine silica powder, fine titanium powder and fine alumina powder. Particularly, fine silica powder is preferably used. In particular, those having a specific surface area, as measured by the BET method using nitrogen gas absorption, of 30 $m^2/g$ or above and particularly ranging from 50 to 400 $m^2/g$ can provide good results. The inorganic fine powder may be used in an amount of from 0.01 to 8 parts by weight, and preferably from 0.1 to 5 parts by weight, based on 100 parts by weight the toner particles. The specific surface area of the inorganic fine powder can be calculated in the manner described later, by the BET method as in the case of the specific surface area of toners.

For the purposes of making hydrophobic and control of chargeability, the inorganic fine powder used in the present invention may preferably be treated with a treating agent such as silicone varnish, modified silicone varnish of various types, silicone oil, modified silicone oil of various types, a silane coupling agent, a silane coupling agent having a functional group, or other organosilicon compound. In particular, hydrophobic silica treated with silicone oil and/or a silane coupling agent is preferred.

Other additives which may be contained in the toner of the present invention may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); anti-caking agents; conductivity-providing agents such as carbon black, zinc oxide, antimony oxide and tin oxide; and developing performance improvers such as white fine powder or black fine powder with a polarity reverse to that of toner particles.

In the present invention, in the case of the toner produced by adding the inorganic fine powder and other additives to toner particles, followed by stirring and mixing, the various physical properties possessed by the toner particles may be measured using toner particles from which the inorganic fine powder and other additives have been removed. There are no particular limitations on how to remove the inorganic fine powder and other additives. For example, these may be removed by washing the toner with water in the following way.

First, in a water to which a surface-active agent such as sodium dodecylbenzenesulfonate has been added, the toner is added, which are then thoroughly stirred and mixed. Upon this operation, the inorganic fine powder and other additives which have relatively large particle diameters come apart from the toner particles and the inorganic fine powder and other additives become separately dispersed in water. Then, the toner particles are isolated from this mixed dispersion. As a method of isolation, for example, filtration may be made using a filter paper having appropriate meshes, whereby the toner particles can be separated on the filter paper and the inorganic fine powder and other additives can be separated in the filtrate as an aqueous solution containing them. As another method of isolation, a method may also be employed in which the mixed dispersion is subjected to wet-process classification to isolate the toner particles.

The toner of the present invention is a toner whose main glass transition temperature (Tg) is observable at 40° C. to 70° C. in a DSC curve as measured with a differential scanning calorimeter. Where in the present invention a plurality of resins having different glass transition temperatures are used, a plurality of glass transition temperatures may be observed in DSC (differential scanning calorimetry). In such a case, the temperature at which a greater, or the greatest, endotherm is defined to be the main glass transition temperature.

A main glass transition temperature lower than 40° C. is not preferable because the toner may have a low blocking resistance to have a low fluidity in the developing assembly or very tends to melt-adhere onto the toner-carrying member or electrostatic latent image bearing member. If it is higher than 70° C., the toner to which a stated quantity of heat has been imparted may have a high melt viscosity, resulting in a high fixing temperature. More specifically, a large quantity of heat is required or, in order to perform fixing in the same quantity of heat, for example a high pressure must be applied to the transfer medium, undesirably. The toner of the present invention may more preferably have a main glass transition temperature of from 42 to 68° C., and particularly from 45 to 65° C.

The DSC curve of the toner in the present invention can be prepared by measurement with, in view of the principle of measurement, a differential scanning calorimeter of a highly precise, inner-heat input compensation type. For example, it is possible to use DSC-7, manufactured by Perkin Elmer Co. The measurement may be made according to ASTM D3418-82. The temperature at the detecting portion of the device is corrected on the basis of melting points of indium and zinc, and the quantity of heat is corrected on the basis of heat of fusion of indium. In the measurement, a sample is put in a pan made of aluminum and an empty pan is set as a control. The measurement may be made at a rate of temperature rise of 10° C./min.

Specifically, the glass transition temperature (Tg) can be made in the following way.

Figure 8:
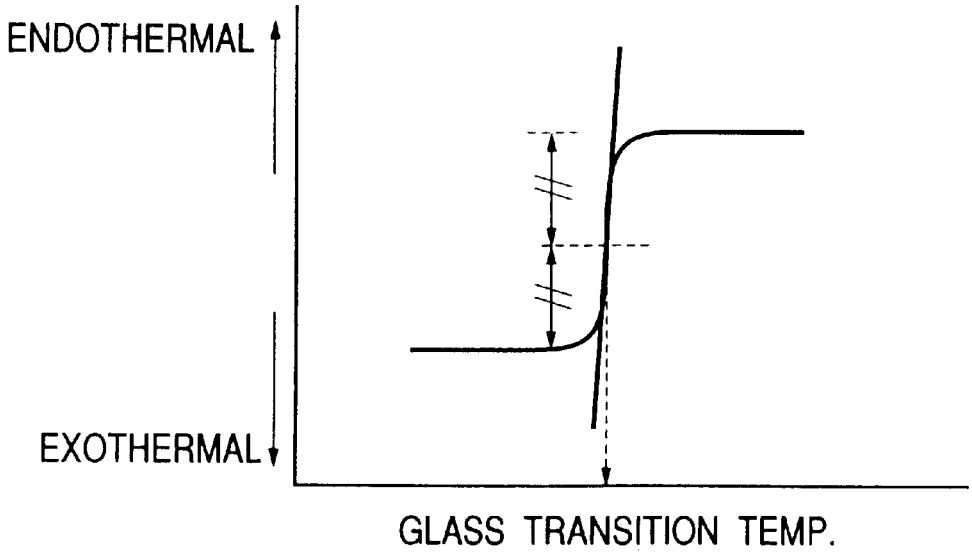
FIG. 8 is a graphic representation used for measuring glass transition temperatures.

The temperature of the sample is once raised and then dropped. Thereafter, from the DSC curve at the time of second-time temperature rise, the point at which a middle line between the base line before appearance of the endothermic peak and the base line after appearance of the endothermic peak intersects with the rising curve is regarded as the glass transition point (Tg) (see FIG. 8).

To make the glass transition temperature (Tg) observable at 40 to 70° C. in the DSC curve formed by measurement with a differential scanning calorimeter, specifically the types and proportion of polymerizable monomers may be changed to make adjustment.

The toner of the present invention satisfies the relationship of $0.8 \leqq A \leqq 4.0$ and $0.80 \leqq (B/A) \leqq 1.05$ where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$). If the A is smaller than 0.8, there may be a strong tendency that it is difficult to control the fluidity of toner and images with a high resolution can be obtained with difficulty. If it is larger than 4.0, the toner may have uneven charging performance or may have a poor matching to the toner-carrying member and electrostatic latent image bearing member, so that it may become difficult to obtain high-quality images. It may more preferably be in the range of $1.0 \leqq A \leqq 3.0$. Also, the value of (B/A) may preferably be in the range of $0.85 \leqq (B/A) \leqq 1.05$, more preferably in the range of $0.90 \leqq (B/A) \leqq 1.05$, particularly $0.92 \leqq (B/A) \leqq 1.03$, and most preferably $0.92 \leqq (B/A) \leqq 1.00$.

Reduction of the value of (B/A) indicates that the external additive such as silica present on toner particle surfaces becomes buried upon leaving for 72 hours in the environment of 50° C. atmospheric temperature and 3% relative humidity. If this value is smaller than 0.80, there is a tendency that any high-quality images can not stably be obtained. Value of (B/A) that is more than 1.05 indicates that the toner particles themselves deform greatly, and any high-quality images may also not stably be obtained in some cases.

The specific surface area measured by the BET method is area measured, e.g., in the following way: Nitrogen gas is adsorbed on sample surfaces using a specific surface area measuring device AUTOSOBE 1 (manufactured by Yuasa Ionics Co.) and the specific surface area is calculated by the BET multiple point method.

There are no particular limitations on a process for producing the toner that satisfies the above definition relating to the BET specific surface area. For example, it can be achieved by producing resin particles containing the diene monomer by pulverization or polymerization, and reacting unreacted double bonds possessed by diene monomers present in the vicinity of the surfaces.

The toner particles thus obtained can have a higher strength because it can take a three-dimensional structure without any great damage of the flexibility of particle surfaces. Hence, even when the toner is left in a high-temperature and high-humidity environment, the external additive may hardly become buried in toner particles, and the toner particles themselves can be kept from their deformation. Also, a network structure attributable to the diene monomer is formed at the toner particle surfaces, and hence the toner may hardly be affected by the water in air, so that a much higher charging stability can be achieved.

Incidentally, the toner production process of the present invention will be described later in detail.

In order to improve transfer performance and developing performance in a well balanced state, the toner of the present invention is required to have the following particle shape. More specifically, the transfer performance and developing performance can be improved in a well balanced state by precisely controlling particle shape of the toner in such a way that the toner has, in its number-based particle diameter frequency distribution (more specifically, in a toner's number-based circle-corresponding diameter/circularity scatter diagram as measured with a flow type particle image analyzer), a circle-corresponding number-average particle diameter of from 2 μm to 10 μm and has, in its circularity frequency distribution, an average circularity of from 0.950 to 0.995, preferably from 0.960 to 0.995 and more preferably from 0.970 to 0.995, and a circularity standard deviation of less than 0.040, and preferably less than 0.035.

When the toner is made to have, in its number-based particle diameter frequency distribution, a circle-corresponding number-average particle diameter D1 (μm) of from 2 to 10 μm to have a small particle diameter, the reproducibility of images at their contour portions can be improved especially in the development of character images or line patterns. In general, however, making toner particles have small particle diameters necessarily results in a high percentage for the presence of toner having a minute particle diameter. Hence, the toner may uniformly be charged with difficulty to not only cause image fog but also adhere to the surface of the electrostatic latent image bearing member at a great force, consequently tending to cause an increase in transfer residual toner.

Since, however, the toner of the present invention is controlled to have, in its circularity frequency distribution, the circularity standard deviation as described above, it can be improved in its stability of developing performance and transfer performance against environmental variations and further in its running performance. The reason therefor is considered as follows: When in the developing step a toner thin layer is formed on the toner-carrying member, a sufficient toner coat quantity can be kept even if the toner layer thickness regulation member is set at a stronger regulation force than usual, and hence the charge quantity of toner on the toner-carrying member can be made larger than usual without damaging the toner-carrying member.

When the toner is made to have an average circularity of from 0.950 to 0.995 and preferably from 0.970 to 0.995 in its circularity frequency distribution, the toner having a small particle diameter can greatly be improved in transfer performance, which has ever been difficult to do so, and also can greatly be improved in the developability for low-potential latent images. This is achievable very effectively, especially when minute spot latent images of a digital type are developed. If the toner has an average circularity less than 0.950, the toner may have not only a low transfer performance but also a low developing performance. If on the other hand it has an average circularity more than 0.995, the toner particle surfaces may greatly deteriorate to tend to cause a problem on running performance and so forth.

In spherical toners having such an average circularity of from 0.950 to 0.995, particles usually come into contact with each other pont to point, and hence the external additive present on the toner particle surfaces may become buried in toner particles. In the toner of the present invention, however, the network structure attributable to the diene monomer is formed at toner particle surfaces, and hence the particles have a surface strength high enough for the external additive to be kept from becoming buried. Thus, even when the toner is used over a long period time, good performances at the initial stage can be maintained. This tendency is especially remarkable in the toner having an average circularity of from 0.970 to 0.995.

When an intermediate transfer system is taken in the transfer step so that various types of recording mediums can be dealt with, the transfer step is substantially doubled. Hence, in general, transfer efficiency greatly lowers to causes a lowering of the utilization efficiency of toners, and may come into question. In digital full-color copying machines or printers, a color image original must be previously color separated using a B (blue) filter, a G (green) filter and a R (red) filter and thereafter a 20 to 70 μm dot latent image must be formed on the photosensitive member so that a multi-color image faithful to the original can be reproduced by utilizing the action of subtractive mixture using a Y (yellow) toner, a M (magenta) toner, a C (cyan) toner and a B (black) toner. Here, individual color toners, the Y toner, M toner, C toner and B toner, are laid superimposingly on the photosensitive member or intermediate transfer member in a large quantity in accordance with the color information of the original or CRT, and hence the color toners used in the present invention are required to have a very high transfer performance. To meet such a high-level requirement, the toner may preferably have the average circularity of from 0.950 to 0.995, and preferably from 0.970 to 0.995, and the circularity standard deviation of less than 0.040, and preferably less than 0.035, as described above.

In the toner of the present invention, toner particles having, in the toner's number-based circle-corresponding diameter/circularity scatter diagram as measured with a flow type particle image analyzer, an average circularity less than 0.950 may preferably be in a content less than 15% by number. If the toner particles having an average circularity less than 0.950 is in a content more than 15% by weight, the transfer residual toner tends to increase undesirably.

The circularity referring to in the present invention is used as a simple method for expressing the shape of particles quantitatively. In the present invention, the shape of particles is measured with a flow type particle image analyzer. FPIA-1000, manufactured by Toa Iyou Denshi K.K., and the circularity is calculated according to the following equation. As also further shown in the following equation, the value obtained when the sum total of circularity of all particles measured is divided by the number of all particles is defined to be the average circularity.

$$\text{Circularity} = \frac{\text{Circumferential length of a circle with the same area as particle projected area}}{\text{Circumferential length of particle projected image}}$$

Average circularity $$\bar{c} = \sum_{i=1}^{m} (c_i / m)$$

Circularity standard deviation $$SDc = \left\{ \sum_{i=1}^{m} (\bar{c} - c_i)^2 / m \right\}^{1/2}$$

Here, the "particle projected area" is meant to be the area of a binary-coded toner particle image, and the "circumferential length of particle projected image" is defined to be the length of a contour line formed by connecting edge points of the toner particle image.

The measuring device "FPIA-1000" used in the present invention employs a calculation method in which, in calculating the circularity of each particle and thereafter calculating the average circularity and circularity standard deviation, circularities of 0.400 to 1.000 are divided into division ranges, which are divided into 61 ranges at intervals of 0.010 as from 0.400 to less than 0.410, from 0.410 to less than 0.420, . . . from 0.990 to less than 1.000, and 1.000, and the average circularity and circularity standard deviation are calculated using the center values and frequencies of divided points.

Between the values of the average circularity and circularity standard deviation calculated by this calculation method and the values of the average circularity and circularity standard deviation calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified is used, for the reasons of handling data, e.g., making the calculation time short and making the operational equation for calculation simple.

The circularity referring to in the present invention is an index showing the degree of surface unevenness of particles. It is indicated as 1.000 when the particles are perfectly spherical. The complicate the surface shape is, the smaller the value of circularity is.

The circle-corresponding diameter is a value defined to be:

$$\text{Circle-corresponding diameter}=(\text{particle projected area}/\pi)^{1/2}\times 2.$$

The circle-corresponding number-average particle diameter (D1) represents a number-based, average value of the circle-corresponding diameters of toner and, where the particle diameter (center value) at a divided point i is represented by di and the frequency at that point by fi, it is expressed by the following equation.

Circle-corresponding number-average particle diameter $$(D1)=\sum_{i=1}^{n}(fi\times di)\Big/\sum_{i=1}^{n}fi$$

Similarly, its standard deviation is expressed as follows:

Circle-corresponding diameter standard deviation $$SDd=\left(\sum_{i=1}^{n}(D1-di)^2\Big/\sum_{i=1}^{n}fi\right)^{1/2}$$

The divided points of the particle size distribution in the present invention are as shown in the following table.

In the following table, the upper-limit numeral in each particle diameter range does not include that numeral itself to mean that it is indicated as "less than".

TABLE

| Particle diameter ranges | | | |
|---|---|---|---|
| (μm) | (μm) | (μm) | (μm) |
| 0.60–0.61 | 1.12–1.16 | 2.12–2.18 | 4.00–4.12 |
| 0.61–0.63 | 1.16–1.19 | 2.18–2.25 | 4.12–4.24 |
| 0.63–0.65 | 1.19–1.23 | 2.25–2.31 | 4.24–4.36 |
| 0.65–0.67 | 1.23–1.26 | 2.31–2.38 | 4.36–4.49 |
| 0.67–0.69 | 1.26–1.30 | 2.38–2.45 | 4.49–4.62 |
| 0.69–0.71 | 1.30–1.34 | 2.45–2.52 | 4.62–4.76 |
| 0.71–0.73 | 1.34–1.38 | 2.52–2.60 | 4.76–4.90 |
| 0.73–0.75 | 1.38–1.42 | 2.60–2.67 | 4.90–5.04 |
| 0.75–0.77 | 1.42–1.46 | 2.67–2.75 | 5.04–5.19 |
| 0.77–0.80 | 1.46–1.50 | 2.75–2.83 | 5.19–5.34 |
| 0.80–0.82 | 1.50–1.55 | 2.83–2.91 | 5.34–5.49 |
| 0.82–0.84 | 1.55–1.59 | 2.91–3.00 | 5.49–5.65 |
| 0.84–0.87 | 1.59–1.64 | 3.00–3.09 | 5.65–5.82 |
| 0.87–0.89 | 1.64–1.69 | 3.09–3.18 | 5.82–5.99 |

TABLE-continued

| Particle diameter ranges | | | |
|---|---|---|---|
| (μm) | (μm) | (μm) | (μm) |
| 0.89–0.92 | 1.69–1.73 | 3.18–3.27 | 5.99–6.16 |
| 0.92–0.95 | 1.73–1.79 | 3.27–3.37 | 6.16–6.34 |
| 0.95–0.97 | 1.79–1.84 | 3.37–3.46 | 6.34–6.53 |
| 0.97–1.00 | 1.84–1.89 | 3.46–3.57 | 6.53–6.72 |
| 1.00–1.03 | 1.89–1.95 | 3.57–3.67 | 6.72–6.92 |
| 1.03–1.06 | 1.95–2.00 | 3.67–3.78 | 6.92–7.12 |
| 1.06–1.09 | 2.00–2.06 | 3.78–3.89 | 7.12–7.33 |
| 1.09–1.12 | 2.06–2.12 | 3.89–4.00 | 7.33–7.54 |
| 7.54–7.76 | 14.20–14.62 | 26.75–27.53 | 50.37–51.84 |
| 7.76–7.99 | 14.62–15.04 | 27.53–28.33 | 51.84–53.36 |
| 7.99–8.22 | 15.04–15.48 | 28.33–29.16 | 53.36–54.91 |
| 8.22–8.46 | 15.48–15.93 | 29.16–30.01 | 54.91–56.52 |
| 8.46–8.71 | 15.93–16.40 | 30.01–30.89 | 56.52–58.17 |
| 8.71–8.96 | 16.40–16.88 | 30.89–31.79 | 58.17–59.86 |
| 8.96–9.22 | 16.88–17.37 | 31.79–32.72 | 59.86–61.61 |
| 9.22–9.49 | 17.37–17.88 | 32.72–33.67 | 61.61–63.41 |
| 9.49–9.77 | 17.88–18.40 | 33.67–34.65 | 63.41–65.26 |
| 9.77–10.05 | 18.40–18.94 | 34.65–35.67 | 65.26–67.16 |
| 10.05–10.35 | 18.94–19.49 | 35.67–36.71 | 67.16–69.12 |
| 10.35–10.65 | 19.49–20.06 | 36.71–37.78 | 69.12–71.14 |
| 10.65–10.96 | 20.06–20.65 | 37.78–38.88 | 71.14–73.22 |
| 10.96–11.28 | 20.65–21.25 | 38.88–40.02 | 73.22–75.36 |
| 11.28–11.61 | 21.25–21.87 | 40.02–41.18 | 75.36–77.56 |
| 11.61–11.95 | 21.87–22.51 | 41.18–42.39 | 77.56–79.82 |
| 11.95–12.30 | 22.51–23.16 | 42.39–43.62 | 79.82–82.15 |
| 12.30–12.66 | 23.16–23.84 | 43.62–44.90 | 82.15–84.55 |
| 12.66–13.03 | 23.84–24.54 | 44.90–46.21 | 84.55–87.01 |
| 13.03–13.41 | 24.54–25.25 | 46.21–47.56 | 87.01–89.55 |
| 13.41–13.80 | 25.25–25.99 | 47.56–48.94 | 89.55–92.17 |
| 13.80–14.20 | 25.99–26.75 | 48.94–50.37 | 92.17–94.86 |
| 94.86–97.63 | 178.63–183.84 | 336.37–346.19 | |
| 97.63–100.48 | 183.84–189.21 | 346.19–356.29 | |
| 100.48–103.41 | 189.21–194.73 | 356.29–366.69 | |
| 103.41–106.43 | 194.73–200.41 | 366.69–377.40 | |
| 106.43–109.53 | 200.41–206.26 | 377.40–388.41 | |
| 109.53–112.73 | 206.26–212.28 | 388.41–400.00 | |
| 112.73–116.02 | 212.28–218.48 | | |
| 116.02–119.41 | 218.48–224.86 | | |
| 119.41–122.89 | 224.86–231.42 | | |
| 122.89–126.48 | 231.42–238.17 | | |
| 126.48–130.17 | 238.17–245.12 | | |
| 130.17–133.97 | 245.12–252.28 | | |
| 133.97–137.88 | 252.28–259.64 | | |
| 137.88–141.90 | 259.64–267.22 | | |
| 141.90–146.05 | 267.22–275.02 | | |
| 146.05–150.31 | 275.02–283.05 | | |
| 150.31–154.70 | 283.05–291.31 | | |
| 154.70–159.21 | 291.31–299.81 | | |
| 159.21–163.86 | 299.81–308.56 | | |
| 163.86–168.64 | 308.56–317.56 | | |
| 168.64–173.56 | 317.56–326.83 | | |
| 173.56–178.63 | 326.83–336.37 | | |

As a specific measuring method, 10 ml of ion-exchanged water from which impurity solid matter has been removed is put in a container, and as a dispersant a surface-active agent, preferably alkylbenzene sulfonate, is added therein. Thereafter, 0.02 g of a measuring sample is further added therein, followed by uniform dispersion. As a means for the dispersion, an ultrasonic dispersion machine UH-50 (manufactured by SMT Co.) to which a 5 mm diameter titanium alloy tip is attached as a vibrator is used, and dispersion treatment is made for 5 minutes to prepare a dispersion for measurement. Here, the dispersion is appropriately cooled so that its temperature does not exceed 40° C.

As a specific method for measuring the circularity and circle-corresponding diameter, about 5 mg of toner is dispersed in 10 ml of water in which about 0.1 mg of a nonionic surface-active agent has been dissolved, to prepare a dispersion, and concentration of the dispersion is so adjusted that the toner particles are in a concentration of from 5,000 to 20,000 particles/μl by irradiating the dispersant by ultrasound (20 KHz, 50 W). Using the above flow type particle image analyzer, the circularity distribution of particles having circle-corresponding diameters of from 0.60 μm to less than 159.21 μm are measured.

The summary of measurement is described in a catalog of FPIA-1000 (an issue of June, 1995), published by Toa Iyou Denshi K.K., and in an operation manual of the measuring apparatus and Japanese Patent Application Laid-Open No. 8-136439, and is as follows:

The sample dispersion is passed through channels (extending along the flow direction) of a flat transparent flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and the circumferential length of the projected image, using the above circularity calculation equation. In the present invention, the measurement is made on the particles having circle-corresponding diameters of from 0.60 μm to less than 159.21 μm.

To control the shape of toner particles as described above, specifically the manner of polymerization and polymerization temperature may be adjusted in the case of polymerization toners, and the conditions for pulverization may be adjusted in the case of pulverization toners.

The dry toner of the present invention has, in its molecular-weight distribution of tetrahydrofuran(THF)-soluble matter as measured by gel permeation chromatography (GPC), a main-peak molecular weight in the region of from 2,000 to 100,000 and contains a THF-insoluble matter in an amount of from 5% by weight to 60% by weight.

In the present invention, the molecular weight of the binder resin contained in the toner is a value determined from molecular weight distribution in GPC as molecular weight calculated as polystyrene. The toner of the present invention has, in its molecular-weight distribution of THF-soluble matter as measured by GPC, a main-peak molecular weight in the region of from 2,000 to 100,000, and preferably in the region of from 5,000 to 50,000. If it has a main-peak molecular weight in the region lower than 2,000, it may adversely affect charging performance and also, when stored in an environment of high humidity, the resin component containing the diene monomer may migrate to toner particle surfaces to adversely affect blocking resistance. If the toner has a main-peak molecular weight in the region exceeding 100,000, the toner may have so excessively high a melt viscosity as to cause a problem on fixing performance, or the flexibility of the resin component containing the diene monomer can not effectively be brought out to cause, e.g., low-temperature offset.

In the present invention, the THF-soluble matter of the toner is a toner component that is soluble in THF. Stated specifically, it is chiefly composed of the binder resin, and may also include the wax component. The THF-soluble matter of the toner can be determined in the following way.

A toner sample is put in THF, which is then left for several hours, followed by thorough shaking to well mix the sample with THF (until no coalesced sample comes to be seen), and the mixture is further allowed to stand still for at least 12 hours. Here, leaving time in THF is set to be at least 24 hours. Thereafter, the mixture is passed through a sample-treating filter (pore size: 0.2 μm; for example, MAISHORI DISK H-25-5, available from Toso Co., Ltd., or EKIKURO DISK 25CR, available from German Science Japan, Ltd., may be used), thus the THF-soluble matter can be separated. The solution obtained is used as the sample for GPC after its concentration is adjusted to be 0.5 to 5 mg/ml as binder resin component.

In the present invention, the molecular weight of chromatogram by GPC of the THF-soluble matter of the toner can be measured under the following conditions.

Columns are stabilized in a heat chamber of 40° C. To the columns kept at this temperature, THF (tetrahydrofuran) as a solvent is flowed at a flow rate of 1 ml per minute, and about 100 μl of THF-soluble toner sample solution (the THF-soluble matter) is injected thereinto to make measurement. In measuring the molecular weight of the toner sample, the molecular weight distribution ascribed to the sample is calculated from the relationship between the logarithmic value and count number of a calibration curve prepared using several kinds of monodisperse polystyrene standard samples.

As the standard polystyrene samples used for the preparation of the calibration curve, it is suitable to use at least about 10 standard polystyrene samples. The calibration curve may be prepared using, e.g. TSK Standard Polystyrene F-850, F-450, F-288, F-128, F-80, F-40, F-20, F-10, F-4, F-2, F-1, A-5000, A-2500, A-1000 or A-500, available from Toso Co., Ltd.

Also used is a detector in which an RI (refractive index) detector and a UV (ultraviolet) detector are arranged in series. Columns should be used in combination of a plurality of commercially available polystyrene gel columns. In the present invention, they may preferably comprise, e.g., a combination of Shodex GPC KF-801, KF-802, KF-803, KF-804, KF-805, KF-806, KF-807 and KF-800P, available from Showa Denko K.K. As an apparatus, a high-speed GPC equipment HPLC8120 GPC, manufactured by Toso Co., Ltd., may be used.

In the toner of the present invention, the THF-insoluble matter must be in a content of from 5 to 60% by weight, and preferably from 5 to 55% by weight. When the THF-insoluble matter is present in an amount of 5% by weight or more, the formation of three-demensional structure in the vicinity of toner particle surfaces that is attributable to the diene monomer is considered to take place well. If the THF-insoluble matter is less than 5% by weight, the formation of three-dimensional structure in the vicinity of toner particle surfaces may be insufficient and hence running performance in a high-temperature environment may inevitably deteriorate and also it may be difficult for the toner to retain charging stability over a long period of time. If on the other hand the THF-insoluble matter is more than 60% by weight, the feature assigned to the flexibility possessed by the binder resin containing the diene monomer may be exhibited with difficulty, tending to cause offset at the time of fixing.

In the present invention, the diene monomer enables the THF-insoluble matter to be controlled relatively with ease. More specifically, the content of THF-insoluble matter can be made larger by making larger the content of the diene monomer in the toner.

However, the THF-insoluble matter in the toner of the present invention does not depend only on the quantity of the diene monomer. In the case when the toner is produced by pulverization, it depends on the quantity of the diene monomer and on, e.g., the quantity of a polymerization initiator added in order to react unreacted double bonds present in the vicinity of toner particle surfaces. In such a case, there is a tendency of being greatly influenced by the quantity of the diene monomer. Also, in the case when the toner is produced by polymerization, the THF-insoluble matter is influenced by the quantity of the diene monomer and the quantity of a polymerization initiator added at the time of polymerization reaction or reaction treatment and also on, e.g., the polymerization temperature or the temperature at the time of reaction treatment. Changing the amount of the polymerization initiator used brings about a great influence also on the peak molecular weight of the THF-insoluble matter. Accordingly, in the present invention, the quantity of the THF-insoluble matter, too, must be taken into consideration when the THF-insoluble matter is adjusted.

Besides the foregoing, the like effect can also be obtained by incorporating a monomer having two or more polymerizable double bonds.

Such a monomer can be exemplified by o-, m- or p-divinylbenzene, ethylene glycol diacrylate or dimethacrylate, diethylene glycol diacrylate or dimethacrylate, triethylene glycol acrylate or methacrylate, o-, m- or p-divinylcyclohexane, trimethylolethane triacrylate or trimethacrylate, trimethylolpropane triacrylate or trimethacrylate, and pentaerythritol tetraacrylate or tetramethacrylate. Any of these monomers may be used alone, or in combination of two or more types without any difficulty.

In the present invention, the THF-insoluble matter of the toner indicates the weight proportion of a binder resin component that has become insoluble in THF in resin compositions of toner particles. It can be a standard showing the degree of cross-linkage of resin compositions containing a cross-linking component. However, even when the THF-insoluble matter is 0% by weight, it by no means follows that the resin does not stand cross-linked. In the present invention, the THF-insoluble matter is defined by a value measured in the following way.

Where the toner is a non-magnetic toner, pigment content and so forth are previously measured. Where the toner is a magnetic toner, pigment content, magnetic-material content and so forth are previously measured. Next, a toner sample is weighed in an amount of from 0.5 to 1.0 g ($W_1$ g), which is then put in a cylindrical filter paper (No. 86R, available from Toyo Roshi K.K.) and set on a Soxhlet extractor. Extraction is carried out for 20 hours using from 100 to 200 ml of THF as a solvent, and the soluble component extracted by the use of the solvent is evaporated, followed by vacuum drying at 100° C. for several hours. Then the THF-soluble resin component is weighed ($W_2$ g). Among pigments and magnetic materials which are contained in the toner, the weight of components soluble in THF is represented by $W_3$ g, and the components insoluble in THF by $W_4$ g. The THF-insoluble matter in the resin composition can be calculated according to the following expression.

$$\text{THF-insoluble matter (\% by weight)}=[(W_1-W_2-W_4)/(W_1-W_3-W_4]\times 100$$

2. Dry Toner Production Process of the Invention

Various methods are available as the process for producing the toner of the present invention. Part or the whole of the toner may preferably be produced by polymerization. Producing part of the toner by polymerization refers to a process in which only the binder resin is polymerized by applying solution polymerization, bulk polymerization, suspension polymerization, emulsion polymerization, block copolymerization or grafting, followed by pulverization or melt spraying to obtain toner particles. Producing the whole of the toner by polymerization refers to a process in which the colorant, the charge control agent and so forth are added and mixed in monomers, followed by polymerization to obtain toner particles, which is a process where the production of binder resin and the production of toner are simultaneously carried out.

In the case when the toner of the present invention is produced by pulverization, the diene-monomer-containing resin, the wax component, the colorant (the magnetic material is also usable), the resin optionally used in combination, the charge control agent and other additives are well mixed by means of a Henschel mixer or a ball mill, thereafter the mixture obtained is melt-kneaded using a pressure kneader or an extruder, then the kneaded product is cooled to solidify, and the resultant solid material is caused to collide against a target by a mechanical means or through a jet stream so as to be finely pulverized to have the desired toner particle diameters. Thereafter, the pulverized product is optionally treated to make toner particles smooth and spherical. Subsequently, the toner particles are brought to a classification step to make their particle size distribution sharp. The classified powder is further well mixed with an external additive such as fine silica particles by means of a mixing machine such as a Henschel mixer, thus the toner of the present invention can be obtained. As the production process of the present invention, for example, the toner particles having been made spherical are allowed to react with the diene-monomer-containing resin in the presence of the polymerization initiator and together with the polymerizable monomer optionally added to the resin, whereby the toner particles can have a higher strength in the vicinity of their surfaces.

The diene-monomer-containing resin constituting the binder resin contained in the toner of the present invention may be contained in the toner in any shape and form, and may stand mutually dissolved with other resin(s) constituting the binder resin or stand phase-separated from the latter. In the case when the toner is produced by pulverization, the diene-monomer-containing resin need not stand melted with other resin(s), and may stand dispersed in other resins(s) having been melted. In such a case, the diene-monomer-containing resin in the resin comes to stand dispersed in other resin(s) used in combination. Where the diene-monomer-containing resin and other resin(s) are previously uniformly be dissolved and mixed using a solvent such as xylene, the diene-monomer-containing resin is finely dispersed in other resin(s) or, in some cases, the both are mutually dissolved. Where, without such operation for making uniform, a powder of the diene-monomer-containing resin and other resin(s) are kneaded and also kneaded at a temperature lower than the melt temperature of the diene-monomer-containing resin, the diene-monomer-containing resin is dispersed in the toner in the form of powder. Accordingly, in such a case, a diene-monomer-containing resin finely pulverized to 1 $\mu$m or smaller particles, and preferably 0.5 $\mu$m or smaller particles should be used.

As other processes for producing the toner, there is also a process in which an ultrafinely pulverized diene-monomer-containing resin is added to classified powder obtained in the classification step, together with a fluidizing agent or separately with it, followed by thorough mixing to anchor the diene-monomer-containing resin to toner particle surfaces. In such a case, the diene-monomer-containing resin may be contained in the resin contained in the classified powder, or may be not contained at all. Also, on toner particles after anchoring or after treatment for making spherical, a polymerization initiator and polymerizable monomers optionally added may be adsorbed to cause them to react with the diene-monomer-containing resin present at the surfaces, whereby the toner particles can have a higher strength in the vicinity of their surfaces.

The like effect can also be obtained by a process in which a composition comprised of i) monomer components having the diene-monomer-containing resin and ii) a polymerization initiator is adsorbed on toner particles serving as cores having no diene-monomer-containing resin.

As other processes, like the process as disclosed in Japanese Patent Publication No. 56-13945, a melt-spray process is available in which a melt-kneaded product containing the diene-monomer-containing resin constituting the binder resin is atomized in air by means of a disk or a multiple fluid nozzle to obtain spherical toner particles. Another process is also available in which polymer particles containing no diene monomer are produced by polymerization and thereafter a fine-particle diene-monomer-containing resin is made to adhere to the surfaces of the polymer particles, optionally followed by treatment to make the particles smooth and spherical.

In any of the cases, the binder resin is obtained by by applying solution polymerization, bulk polymerization, suspension polymerization, emulsion polymerization, block copolymerization or grafting.

In the case when the whole of the toner of the present invention is produced by polymerization, usable are a process in which the diene-monomer-containing resin is dissolved in a monomer composition and the toner is directly produced by suspension polymerization as disclosed in Japanese Patent Publication No. 36-10231 and Japanese Patent Application Laid-Open No. 59-61842; by dispersion polymerization for directly producing the toner using an aqueous organic solvent which is soluble in the monomer and insoluble in the resultant polymer; or by emulsion polymerization as typified by soap-free polymerization for producing the toner by direct polymerization carried out in the presence of a polymerization initiator; thus the toner of the present invention can be obtained. A process may also be employed in which surface layers are provided on core particles not having the diene-monomer-containing resin, using the diene-monomer-containing resin and a monomer (composition) of other resin(s). Alternatively, it is preferable to add a step for making toner particles have a higher strength in the vicinity of their surfaces by a process in which, using toner particles having the diene-monomer-containing resin, the diene-monomer-containing resin present at the surfaces is allowed to react with a monomer component remaining in toner particles or added optionally, in the presence of a polymerization initiator, preferably a highly hydrophobic polymerization initiator. Here, it is also preferable to add the diene-monomer-containing resin and a polymerizable monomer together.

The toner of the present invention may also be obtained by subjecting a polymerizable monomer composition containing the diene-monomer-containing resin, other polymerizable vinyl-monomer, the wax component and the colorant, to suspension polymerization, emulsion polymerization or dispersion polymerization under pressure.

Among the toner production processes described above, the melt spraying tends to make the resultant toner have a broad particle size distribution. The dispersion polymerization can make the resultant toner have a very sharp particle size distribution, but provides only a narrow width for the selection of materials used. Also, since it utilizes organic solvents, it tends to require, from the viewpoint of disposal of waste solvents or flammability of solvents, a complicated and troublesome production apparatus. Also, the emulsion polymerization has an advantage that the particle size of toner can be made relatively uniform, but particles formed may commonly have so fine particle size to make it difficult to use them as toner as they are. Also, terminals of the aqueous polymerization initiator used and the emulsifier may be present on toner particle surfaces to cause a lowering of environmental properties of the toner.

On the other hand, the process in which toner particles obtained by pulverization are treated to make them smooth and spherical to produce the toner and the process of producing the toner by suspension polymerization make it easy to control the circularity and circularity standard deviation of toner within the desired ranges, and are preferred processes. In the present invention, the production by suspension polymerization is the most preferred production process.

The process for producing the toner of the present invention by suspension polymerization especially enables easy control of the shape of toner particles, and also is operable by dissolving the diene-monomer-containing resin in the binder resin material monomer composition. Thus, this is a particularly preferred process as many kinds of resins are usable.

In the present invention, various production processes may be used, but what is important is that crosslinkage is formed at toner particle surfaces by reacting the unreacted double bonds the components contained in toner particles have, in particular, the double bonds the component derived from the diene monomer has, after the pulverization of resin in the case of the polymerization process or, in the case of the polymerization process, at the time the polymerization has reached a polymerization conversion described later.

In the present invention, the following production process is particularly preferred.

The diene-monomer-containing resin, the colorant, the wax component, a radical polymerization initiator and optionally other additives are added in the polymerizable vinyl monomer to prepare a polymerizable monomer composition. The polymerizable monomer composition is dispersed in an aqueous medium containing a dispersion stabilizer, by means of a conventional stirrer, homomixer or homogenizer. Granulation is carried out preferably while the stirring speed and stirring time are so controlled that droplets of the monomer composition can have the desired toner particle size. After the granulation, the polymerizable vinyl monomer is polymerized in the aqueous medium while these are stirred to such an extent that the state of particles is maintained and the particles can be prevented from settling, by the action of the dispersion stabilizer, to form toner particles. A radical polymerization initiator is further anew added when the conversion of polymerization reaction is in the range of from 10 to 95% by weight to make toner particles have a higher strength in the vicinity of their surfaces. Such a process may preferably be used.

In the present invention, as the polymerization initiator, radical polymerization initiators may preferably be used which may include azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may commonly be used in an amount of from 0.5 to 20% by weight based on the weight of the polymerizable monomer, which may vary depending on the intended degree of polymerization. The polymerization initiator may a little differ in type depending on the methods for polymerization, and may be used alone or in combination of two or more types selected from the above polymerization initiators, making reference to their 10-hour half-life period temperature.

The radical polymerization initiator further anew added when the conversion of polymerization reaction is in the range of from 10 to 95% by weight may be any of oil-soluble polymerization initiators as those described above. Water-soluble polymerization initiators as show below may also be used.

The water-soluble polymerization initiators may include, e.g., polymerization initiators such as sodium peroxide, potassium peroxide and ammonium peroxide, any of which may be used alone or in combination of two or more types. Such water-soluble polymerization initiators are readily utilizable and preferred because they can be added with ease at the time of toner production and can be added in the form of an aqueous solution. Moreover, the water-soluble, or highly hydrophilic, polymerization initiators act well efficiently on toner particles, i.e., on the diene-monomer-containing resin present at the toner particles, and hence these are preferred also from this point of view.

In contrast, the oil-soluble polymerization initiators can be added in the state it is emulsified or dispersed in water, and hence enable control of reaction under selection of polymerization initiators in a broader range. Thus, these are preferred at least from such a pont of view.

When the radical polymerization initiator is further anew added, it may be used in an amount ranging from 0.5 to 10% by weight based on the weight of the polymerizable monomer, which may vary depending on the intended degree of polymerization.

The aqueous medium may include water, and mixed solvents of water and alcohols. Water may preferably be used. In the suspension polymerization, water may preferably be used as the dispersion medium usually in an amount of from 100 to 5,000 parts by weight based on 100 parts by weight of the polymerizable monomer composition.

In the toner production process of the present invention, the radical polymerization initiator may preferably be further anew added when the conversion of polymerization reaction is in the range of from 10 to 95% by weight. Its addition before the conversion comes to be 10% is not preferable because it follows that, because of a very low conversion of polymerization reaction, the polymerization initiator is in a large quantity with respect to the polymerizable monomer in a state where the shape of toner particles has not become stable, resulting in a too low peak molecular weight of the resultant binder resin component in some cases. The radical polymerization initiator may preferably be further anew added at such timing that the conversion of polymerization reaction is in the range of from 20 to 95% by weight, and particularly from 25 to 90% by weight.

The conversion of polymerization reaction can be measured, e.g., in the following way.

Unreacted polymerizable monomers remaining in a reaction system are determined from a calibration curve prepared previously by using a gas chromatograph, and the value obtained is defined as unconversion rate, where a value obtained by substracting it from 100 is found as conversion (%). Stated specifically, it can be measured by the internal standard method under conditions shown below.

Conversion (%)=100−(unconversion rate determined from calibration curve on the basis of quantity of unreacted polymerizable monomers)

Sample: 5 μl of a specimen (polymerization reaction mixture) and 1 μl of dimethylformamide are put in a vial bottle, which is then hermetically closed.

Measuring device: HP6890 (manufactured by HP).

Carrier ga: Industrial pure helium.

Split (split ratio: 100:1), linear velocity: 35 cm/sec.

Column: HP-INNOWax of 0.2 mm in inner diameter, 50 m in length and 0.4 μm in layer thickness.

Temperature rise: Kept at 40° C. for 2 minutes, and thereafter the temperature is raised to 200° C. at a rate of 20° C. per minute.

Injection inlet temperature: 120° C.

Detector: FID 220° C.

The present invention relating to the production process provides an efficient process in which polymerizable double bonds of the binder resin containing the diene-monomer-containing resin are reacted in the vicinity of toner particle surfaces to form a three-dimensional network to improve the strength of toner particles. If the conversion of polymerization reaction is more than 95% at the time the radical polymerization initiator is further anew added, polymerizable monomers remain in a very small quantity, and it follows that the polymerization initiator is added in a state where toner particles have almost become hard, so that molecular motion in toner particles is very restricted. This is not preferable because it tends to become impossible to well effect the reaction of polymerizable double bonds of the binder resin containing the diene-monomer-containing resin. On the other hand, if the conversion of polymerization reaction does not come to 10% at the time the radical polymerization initiator is further anew added, conversely a free molecular motion is possible. Hence, even though the polymerization initiator is added anew, the reaction may no longer takes place in such a way that the three-dimensional network is formed at toner particle surfaces.

In the present invention, where 10-hour half-life period temperature of the radical polymerization initiator added anew is represented by T1 (° C.) and reaction system temperature at the time it is added by T2 (° C.), it is preferable to satisfy the relationship of $5 \leqq (T2-T1) \leqq 30$. Satisfaction of this relationship is preferable because the radical polymerization initiator can participate in the reaction in a good efficiency.

In the case when the toner is produced by suspension polymerization, the dispersion stabilizer used may include, as inorganic compounds, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, hydroxyethyl cellulose, carboxymethyl cellulose sodium salt, polyacrylic acid and salts thereof, and starch. Any of these dispersion stabilizers may preferably be used in an amount of 0.2 to 2.0 parts by weight based on 100 parts by weight of the polymerizable monomer composition.

As these dispersion stabilizers, when an inorganic compound is used, those commercially available may be used as they are. In order to obtain fine particles, fine particles of the inorganic compound may also be formed in the dispersion medium. For example, in the case of tricalcium phosphate, an aqueous sodium phosphate solution and an aqueous calcium chloride solution may be mixed under high-speed stirring, whereby such a fine-particle dispersion stabilizer can be obtained.

In order to effect fine dispersion of these dispersion stabilizers finer, 0.001 to 0.1% by weight of a surface-active agent may be used in combination. This surface-active agent is used to accelerate the desired action of the dispersion stabilizer, and may include, e.g., anionic surface active agents such as sodium dodecylbenzenesulfonate, sodium dodecylsulfate, sodium tetradecyl sulfate, sodium pentadecyl sulfate, sodium octyl sulfate, sodium oleate, sodium laurate, potassium stearate and calcium oleate; nonionic surface-active agents such as ethylene oxide and/or propylene oxide addition products of alkyl phenols; cationic surface-active agents of an alkylonium salt type; and amphoteric surface-active agents of a betaine type or amino acid type.

The polymerization may preferably be carried out for a time of from 2 to 24 hours. If it is shorter than 2 hours, polymerizable monomers may come not to have any desired conversion and unreacted polymerizable monomers may remain in a large quantity to complicate the step for their removal. If it is longer than 24 hours, the reaction time is so excessively long as to result in a low productivity. Accordingly, the time of from 2 to 24 hours is preferred.

The polymerization may also be carried out at a temperature set at 40° C. or above, and usually from 50 to 90° C. At the latter half of the polymerization reaction, the temperature may be raised, and also the aqueous medium may be removed in part at the latter half of the reaction or after the reaction has been completed, in order to remove unreacted polymerizable monomers, by-products and so forth. After the reaction has been completed, the toner particles formed are washed and thereafter collected by filtration, followed by drying.

In the toner production process in the present invention, in or der to control the degree of polymerization, any known cross-linking agent, chain transfer agent, polymerization inhibitor and so formed may be added and used.

In the case when the toner is produced by polymerization, the particle size distribution and particle diameter of the toner particles may be controlled by controlling the type and amount of the dispersion stabilizer or by controlling the mechanical conditions (e.g., the peripheral speed of a rotor, pass times, the shape of agitating blades and the shape of a reaction vessel) or the concentration of solid matter in the aqueous medium.

3. Image-forming Method of the Invention

The image-forming method of the present invention is an image forming method comprising a charging step of applying a voltage to a charging member to charge an electrostatic latent image bearing member; an electrostatic latent image forming step of forming an electrostatic latent image on the electrostatic latent image bearing member thus charged; a developing step of bringing a toner carried on a toner-carrying member into adhesion to the electrostatic latent image formed on the electrostatic latent image bearing member, to form a toner image on the electrostatic latent image bearing member; a transfer step of transferring the toner image formed on the electrostatic latent image bearing member, to a transfer medium; and a fixing step of fixing the toner image transferred to the transfer medium.

Some embodiments of the image-forming method of the present invention are described below with reference to the drawings, to which, however, the present invention is by no means limited.

Figure 5:
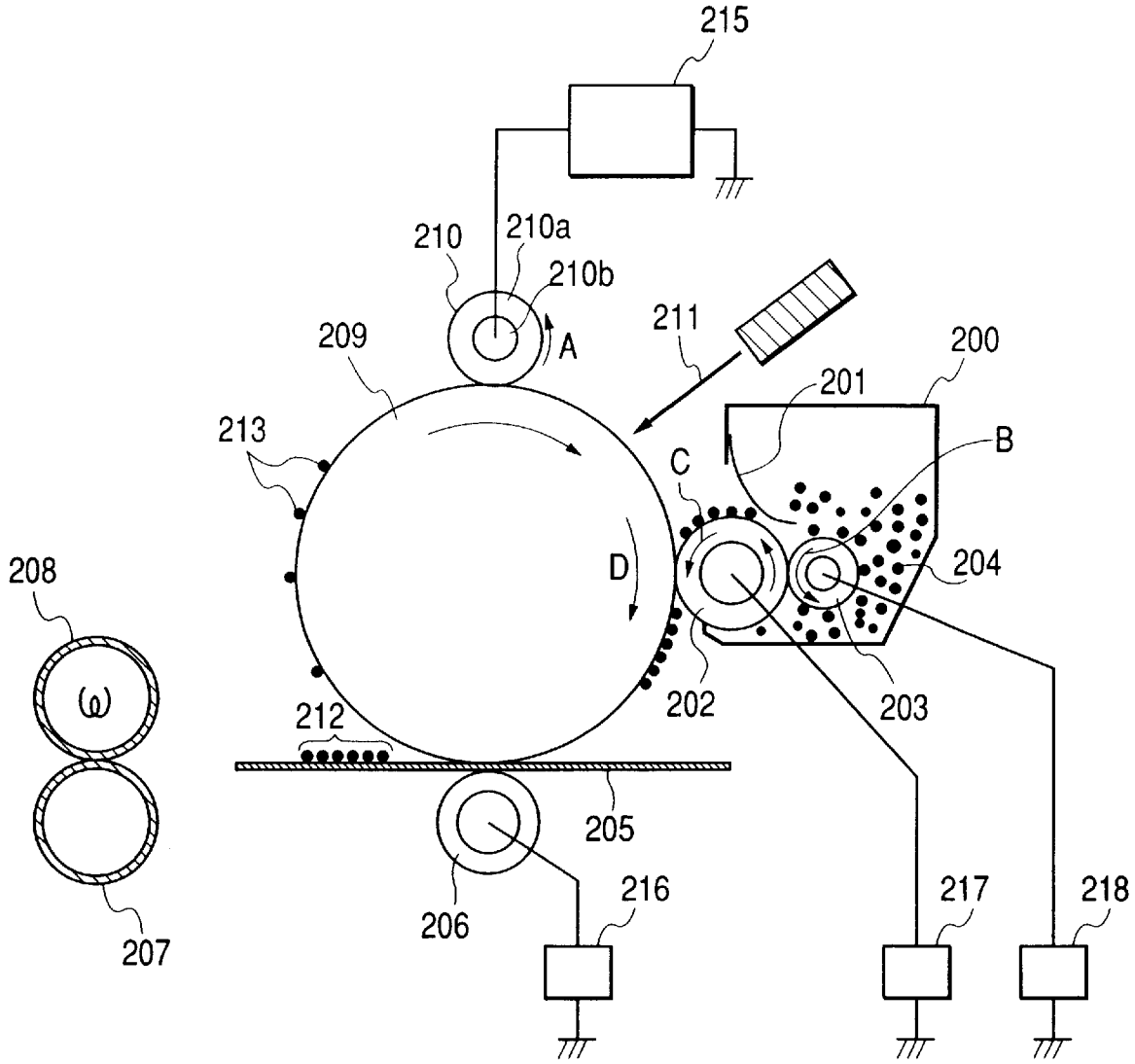
FIG. 5 schematically illustrates the construction of an image-forming apparatus for forming images by a one-component development system.

FIG. 5 shows an image-forming apparatus which performs one-component development.

In the image-forming method of the present invention, as shown in FIG. 5, a toner-carrying member 202 and an electrostatic latent image bearing member (hereinafter often "photosensitive member") 209 may be rotated in the directions opposite to each other or may be rotated in the same direction (in what is shown in FIG. 5, the toner-carrying member 202 is rotated in the direction of an arrow C, and the electrostatic latent image bearing member 209 in the direction of an arrow D).

Surface movement speed (peripheral speed) of the toner-carrying member in a developing zone may preferably be so set as to be a speed 1.05 to 3.0 times the surface movement speed of the electrostatic latent image bearing member (as peripheral speed ratio). Setting the former movement speed to be 1.05 to 3.0 times the latter one makes a toner layer on the toner-carrying member undergo an appropriate agitation effect, and hence electrostatic latent images can faithfully be reproduced in a more improved state.

In the developing step, when development is performed while the electrostatic latent image on the electrostatic latent image bearing member is brought into contact with the toner coated in thin layer on the toner-carrying member (hereinafter simply "contact development"), the agitation effect the toner layer undergoes may become insufficient to make it difficult to achieve a good image quality if the peripheral speed of the toner-carrying member is less than 1.05 times the peripheral speed of the electrostatic latent image bearing member. Also, if so, when images requiring the toner in a large quantity over a wide area as in the case of solid black images are developed, the quantity of the toner fed to electrostatic latent images may become insufficient to tend to cause a decrease in image density. The higher the peripheral speed ratio is, the larger the quantity of the toner fed to the development zone is and the more frequently the toner is attached on and detached from the latent images. Thus, the toner at the unnecessary areas (non-image areas) is collected and the toner is imparted to the necessary areas (image areas); this is repeated, whereupon images faithful to the latent images are formed. Also, as the image-forming method of the present invention, it is possible to apply a cleaning-at-development step described later. In such a cleaning-at-development step, what is important is the operation to regulate chargeability of transfer residual toner by utilizing the difference in peripheral speed between the electrostatic latent image bearing member surface and the part to which the toner has adhered and thereafter collect it by electric-field cleaning. Accordingly, the higher the peripheral speed ratio is, the more advantageous it is for the transfer residual toner to be collected. However, a case in which on the other hand the peripheral speed ratio is greater than 3.0 is not preferable because not only the various problems caused by excessive charging of toner as stated previously (e.g., a decrease in image density ue to excessive charge-up of toner) but also the eterioration of toner due to mechanical stress and the adhesion of toner to the toner-carrying member may occur accelaratively.

As the electrostatic latent image bearing member, a photosensitive drum or photosensitive belt having a photoconductive insulating material layer formed of a-Se, CdS, $ZnO_2$, OPC or a-Si may preferably be used.

An OPC photosensitive member having an organic photosensitive layer containing a binder resin such as polycarbonate resin, polyester resin and acrylic resin is also preferable because it has a good transfer performance and a good cleaning performance and may hardly cause faulty cleaning, melt-adhesion of toner to the photosensitive member and filming of external additives.

In the present invention, in the case when the developing step is of a non-contact development system, the toner-carrying member may preferably have a surface roughness Ra (μm) of from 0.2 to 1.5. Where the surface roughness Ra is set not larger than 1.5, the toner transport performance the toner-carrying member has can be controlled, the toner layer formed on the toner-carrying member can be made thin and also the number of times the toner-carrying member comes into contact with the toner can be made great, and hence the charging performance of the toner can also be improved to cooperatively bring about an improvement in image quality.

In the case when the developing step is of a contact development system, the toner-carrying member may preferably have, as its surface shape, a surface roughness Ra (μm) set to range from 0.2 to 3.0. This is preferable because both high image quality and high running performance can be achieved. The surface roughness Ra correlates with toner transport performance and toner charge performance. If the toner-carrying member has a surface roughness Ra larger than 3.0, not only the toner layer on the toner-carrying member can be made thin with difficulty but also the charging performance of the toner may not be improved, thus no improvement in image quality can be expected. Where the surface roughness Ra is set not larger than 3.0, the toner transport performance the toner-carrying member has can be controlled, the toner layer formed on the toner-carrying member can be made thin and also the number of times the toner-carrying member comes into contact with the toner can be made great, and hence the charging performance of the toner can also be improved to cooperatively bring about an improvement in image quality. If on the other hand the surface roughness Ra is smaller than 0.2, the coat quantity of the toner may be controlled with difficulty.

The toner-carrying member can be made to have the surface roughness Ra within the above range by, e.g., changing the state of abrasion of the toner-carrying member surface layer. More specifically, the toner-carrying member can be made to have a large surface roughness when its surface is roughly abraded, and can be made to have a small surface roughness when its surface is finely abraded.

In the present invention, the surface roughness Ra of the toner-carrying member corresponds to centerline average roughness measured with a surface roughness measuring device (SURFCOADER SE-30H, manufactured by K.K. Kosaka Kenkyusho) according to JIS surface roughness "JIS B-0601". Stated specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following equation and indicated in micrometer (μm) is the surface roughness Ra.

$$Ra = \frac{1}{a} \cdot \int_0^a |f(x)|\, dx$$

As a toner-carrying member having the properties as described above, what is called an elastic roller, having an elastic layer at the surface, may preferably be used.

The elastic roller may be constituted of a mandrel and an elastic layer with which the periphery of the mandrel is covered. As materials for the elastic layer, silicone rubber and Teflon rubber may preferably be used.

The elastic layer used may have a hardness of from 20 to 65 degrees as Asker-C hardness.

The toner-carrying member may also preferably have a resistance within the range of approximately from $10^2$ to $10^9$ Ω·cm as volume resistivity. If it has a volume resistivity lower than $10^2$ Ω·cm, there is a possibility of the flow of excess electric currents when, e.g., the electrostatic latent image bearing member has pinholes on its surface. If on the other hand it has a volume resistivity higher than $10^9$ Ω·cm, the toner tends to cause charge-up due to triboelectric charging to tend to cause a decrease in image density. To make the elastic layer have the volume resistivity within the above range, a conductivity-providing agent such as carbon black or iron oxide may be mixed and dispersed in an elastic material to make adjustment.

The toner quantity on the toner-carrying member is regulated by a regulation member. Such a toner regulation member may include a regulation member disposed leaving a given distance from the toner-carrying member surface, and a regulation member comprised of an elastic member brought into face-to-face touch with the toner-carrying member.

The toner may preferably be coated on the toner-carrying member in a quantity of from 0.1 to 1.5 mg/cm$^2$, and more preferably from 0.2 to 0.9 mg/cm$^2$. If coated in a quantity less than 0.1 mg/cm$^2$, it is difficult to attain a sufficient image density, and, in a quantity larger than 1.5 mg/cm$^2$, it is difficult to uniformly triboelectrically charge all the individual toner particles, providing the cause of fog.

In the present invention, as the regulation member disposed leaving a given distance from the toner-carrying member surface, a doctor blade which is a ferromagnetic metal blade such as a metal blade and a magnetic blade may be used. Alternatively, a rigid-material roller or sleeve formed of metal, resin or ceramic may be used, and a magnetism generating means may be provided in the inside thereof.

As the regulation member comprised of an elastic member brought into face-to-face touch with the toner-carrying member, there are no particular limitations as long as it is an elastic member capable of coating the toner in thin layer under pressure contact, including, e.g., elastic members such as an elastic blade or an elastic roller. A blade formed of an elastic member is preferred.

What is meant by being brought into face-to-face touch with the toner-carrying member is that, e.g., the elastic blade is, at its upper side base portion, fixedly held on the side of a toner container and is so provided that its blade inner face side (or its outer face side in the case of the backward direction) is, at its lower side, brought into touch with the surface of the toner-carrying member under an appropriate elastic pressure in such a state that it is deflected against the elasticity of the blade in the forward direction or backward direction of the rotation of the toner-carrying member. According to such construction, a toner layer which is less affected by environmental variations and is stable and dense can be formed on the toner-carrying member. The reason therefor is not necessarily clear, and it is presumed that the toner is forcibly brought into friction with the toner-carrying member surface by the elastic member and hence the toner is charged always in the like state without regard to any changes in behavior caused by environmental changes of toner.

FIG. 5 shows a developing blade 201 as the regulation member for regulating toner layer thickness. This developing blade 201 comes into contact with the toner-carrying member 202 through the toner layer. Here, it is at a contact pressure of from 5 to 50 g/cm as a preferable range. If the contact pressure is lower than 5 g/cm, it may be difficult not only to control the toner coat quantity but also to effect uniform triboelectric charging, providing the cause of fog. If on the other hand the contact pressure is higher than 50 g/cm, the toner particles may undergo an excess load to tend to cause deformation of particles or the melt-adhesion of toner to the developing blade or toner-carrying member, undesirably.

As the elastic regulation member, it is preferable to select a material of triboelectric series suited for electrostatically charging the toner to the desired polarity, which includes rubber elastic materials such as silicone rubber, urethane rubber or NBR; synthetic resin elastic materials such as polyethylene terephthalate; and metal elastic materials such as stainless steel, steel and phosphor bronze any of which may be used. Also, composite materials of any of these may also be used.

In instances where the elastic regulation member and the toner-carrying member are required to have a durability, resin or rubber may preferably be stuck to, or coated on, the metal elastic material so as to touch the part coming into contact with the sleeve.

An organic or inorganic substance may further be added to, may be melt-mixed in, or may be dispersed in, the elastic regulation member. For example, any of metal oxides, metal powders, ceramics, carbon allotropes, whiskers, inorganic fibers, dyes, pigments and surface-active agents may be added so that the charging performance of the toner can be controlled. Especially when the elastic member is formed of a molded product of rubber or resin, a fine metal oxide powder such as silica, alumina, titania, tin oxide, zirconium oxide or zinc oxide, carbon black, or a charge control agent commonly used in toners may preferably be incorporated therein.

Aiming at loosening action on the toner, a DC electric field and/or an AC electric field may also be applied to the developing blade which is the regulation member for regulating toner quantity on the toner-carrying member, to a feed roller which is a feed member for feeding the toner to the toner-carrying member, and to a brush member. This is also preferable constitution. The uniform thin-layer coating performance and uniform chargeability can be more improved because of the loosening action acting on the toner, so that the toner can smoothly be supplied and taken off at the part where it is supplied, and hence good-quality images having a sufficient image density can be formed.

In the developing step in the present invention, the electrostatic latent image bearing member and the toner-carrying member have a given distance between them and an alternating electric filed is formed across the both to perform development. Such a development method may specifically include jumping development. In the foregoing, "a given distance" means that the distance may be set larger than than the thickness of the toner layer on the toner-carrying member. To form the alternating electric filed across the electrostatic latent image bearing member and the toner-carrying member, for example, an alternating bias may be applied across the both.

Figure 6:
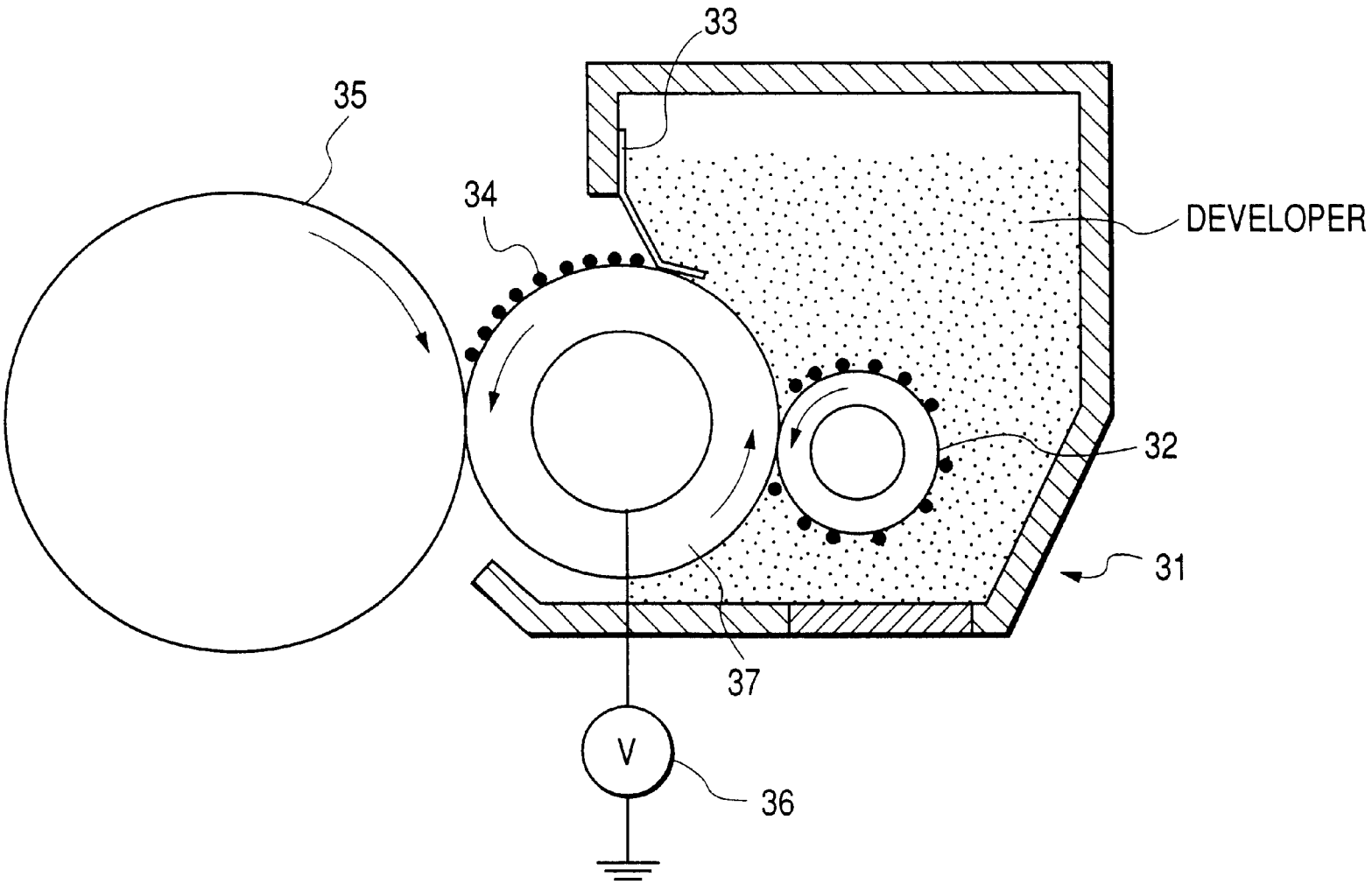
FIG. 6 schematically illustrates the construction of a developing assembly applicable in the image-forming method of the present invention.

As the developing step in the above contact development, development may be performed by a developing means having, e.g., a developing apparatus 31 as shown in FIG. 6. Stated specifically, the development is performed in the state that a toner 34 fed through a coating roller 32 and whose toner layer thickness is regulated with a regulation member developing blade 33 comes into contact with a photosensitive drum 35 while a DC or alternating electric field is applied to a toner-carrying member 37 from a power source 36. As the toner-carrying member, it is preferable to use an elastic roller. When the alternating electric field is applied, any of triangular waveform, rectangular waveform, sinusoidal waveform, waveform with a varied duty ratio and periodic alternating waveform may be used under appropriate selection. In the present invention, however, a DC electric filed is preferably used because of its less load of voltage on the photosensitive drum, and the applied bias is set at a suitable value standing between the dark potential (potential immediately after charging step) and the light potential (potential at exposed areas after exposure step) on the photosensitive drum.

As conditions for the developing step in the image-forming method of the present invention, a reverse development system may preferably be used in either case of the jumping development and the contact development. Also, its use in combination with the cleaning-at-development step (also called "cleanerless process") in which the transfer residual toner remaining on the electrostatic latent image bearing member in the transfer step is collected by the toner-carrying member in the course of development is preferred because it can make the apparatus greatly small-sized.

More specifically, in the case of reverse development, this cleaning-at-development step is done by the action of an electric field for collecting the toner to the toner-carrying member from a dark-potential areas of the electrostatic latent image bearing member, formed by the development bias, and an electric field for making the toner adhere to light-potential areas of the electrostatic latent image bearing member from the toner-carrying member.

Not only at the time of development but also after the transfer step and before the developing step, a DC or AC bias may be applied to the transfer residual toner so that the potential is controlled to enable collection of the toner remaining on the electrostatic latent image bearing member. Here, the DC bias is positioned between light-area potential and dark-area potential.

In the case of the contact development, in the cleaning-at-development step, the electric field acting between the photosensitive member and the elastic roller facing the photosensitive member surface through the toner is utilized to remove the transfer residual toner by cleaning. Hence, it is necessary for the elastic roller surface or the vicinity of the surface to have a potential so that an electric field is formed at a narrow gap between the photosensitive member surface and the toner carrying member surface. Accordingly, it is necessary for the elastic rubber of the elastic roller to be controlled to have a resistance in the medium-resistance region to keep the electric field while preventing its conduction to the photosensitive member surface, or to provided a thin-layer insulating layer on the surface layer of a conductive roller. A construction is also possible which is provided with a conductive resin sleeve comprising a conductive roller coated thereon with an insulating substance on its side facing the photosensitive member surface, or an insulating sleeve provided with a conductive layer on its side not facing the photosensitive member. A construction is still also possible in which a rigid-material roller is used as the toner carrying member and a flexible member such as a belt is used as the photosensitive member. The developing roller as the toner carrying member may preferably have a volume resistivity in the range of from $10^2$ to $10^9$ Ω·cm.

In the image-forming method of the present invention, a monochromatic image-forming method where the cleaning-at-development step is employed is described below with reference to FIG. 5.

As shown in FIG. 5, a developing assembly 200 holds a toner 204, and has a toner carrying member 202 which is rotated in the direction of an arrow C in contact with a photosensitive member 209 which is the electrostatic latent image bearing member. It also has a developing blade 201 which is the regulation member for regulating toner quantity and charging the toner, and a coating roller 203 which is rotated in the direction of an arrow B in order to cause the toner 204 to adhere to the toner carrying member 202 and also charge the toner by its friction with the toner carrying member 202. To the toner carrying member 202, a development bias power source 217 is connected. A bias power source 218 is also connected to the coating roller 203, where a voltage is set on the negative side with respect to the development bias when a negatively chargeable toner is used and on the positive side with respect to the development bias when a positively chargeable toner is used.

A power source 216 for transfer bias with a polarity reverse to that of the photosensitive member 209 is connected to the transfer assembly 206. Here, the length of rotational direction, what is called development nip width, at the contact area between the photosensitive member 209 and the toner carrying member 202 may preferably be from 0.2 mm to 8.0 mm. If it is smaller than 0.2 mm, the amount of development may be too insufficient to attain a satisfactory image density and also the transfer residual toner may not be well collected. If it is larger than 8.0 mm, the toner may be fed in an excessively large quantity to tend to cause fog and also to adversely affect the wear of the photosensitive member.

A charging roller 210 as a primary charging member comes in contact with the photosensitive member 209 and charges it electrostatically. A bias power source 215 is connected to the primary charging member 210 so as to charge the surface of the photosensitive member 209 uniformly. The primary charging member 210 used here is a charging roller constituted basically of a mandrel 210*b* at the center and a conductive elastic layer 210*a* that forms the periphery of the former. The charging roller 210 is brought into pressure contact with the surface of the photosensitive member 209 and is rotated followingly as the photosensitive member 209 is rotated. (The charging roller 210 is rotated in the direction of an arrow A.)

When the charging roller is used, the charging process may preferably be performed under conditions of a roller contact pressure of 5 to 500 g/cm. A charging bias formed of DC voltage or a charging bias formed by superimposing an AC voltage on a DC voltage may be used as an applied voltage. In the present invention, though not particularly limited, the charging bias formed of DC voltage alone may preferably be used. In such an instance, the bias may be applied at a value of from 0.2 to 5 kV as absolute value.

In the image-forming method of the present invention, various charging methods are usable. Preferably usable is the contact charging method in which, as described above, the charging member is brought into contact with the electrostatic latent image bearing member to charge the electrostatic latent image bearing member. When such contact charging method is employed, any transfer residual toner present in a large quantity may adhere to the charging member, so that faulty charging may occur to cause uneven images due to the faulty charging. More specifically, when charged by the contact charging method, the transfer residual toner must be kept in a smaller quantity than in the case of charging by corona discharging or the like carried out in non-contact with the electrostatic latent image bearing member. Accordingly, in the contact charging method, it is preferable to use the toner of the present invention, in which the average circularity and circularity standard deviation have strictly been specified.

As other contact charging methods, there are a method making use of a charging blade as the charging member and a method making use of a conductive brush. Charging in these contact charging methods is preferable because it does not require any high voltage and also can keep ozone from occurring, compared with non-contact corona charging. The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

Subsequently to the primary charging step, an electrostatic latent image corresponding to information signals is formed on the electrostatic latent image bearing member 209 by exposure 211 from a light-emitting device, and the electrostatic latent image is developed by the use of the toner at the position coming into contact with the toner carrying member 202, to form a toner image. Also, the image-forming method of the present invention makes it possible to perform preferable development especially in the case of developing a digital latent image. Next, the toner image is transferred to a transfer medium 205 by means of the transfer assembly 206. Thus, in the image-forming method of the present invention, it is preferable for the photosensitive member 209 and the transfer assembly 206 to come into contact with each other via the transfer medium 205.

Transferred toner image 212 on the transfer medium 205 is further passed through a fixing assembly having a heat roller 208 and a pressure roller 207 as a pressure member, and is fixed to the transfer medium to obtain a permanent image.

The fixing step may be conducted by fixing the toner image onto the transfer medium by heat and pressure by a heating member and a pressure member coming into pressure contact with the heating member.

There are no particular limitations on the fixing step. In the present invention, preferred is a fixing step making use of a heat fixing assembly, and also more preferred is a fixing step of causing a fixing target to pass between a heat roller and a pressure roller face to face brought into pressure contact therewith, to fix the toner image by heat and pressure.

The heating roller may include those internally provided with a heat generator such as a halogen heater. The pressure roller may include those formed of an elastic member.

Figure 3:
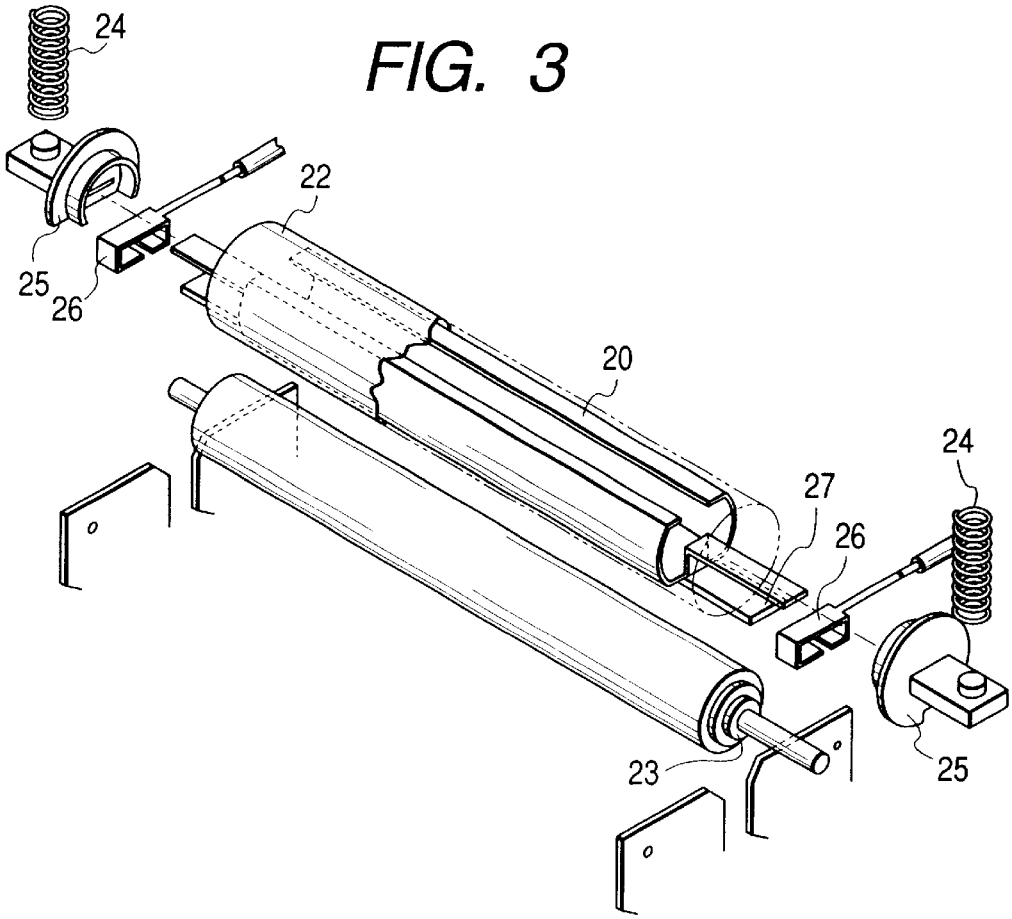
FIG. 3 is an exploded perspective view of the main part of a fixing assembly.
Figure 4:
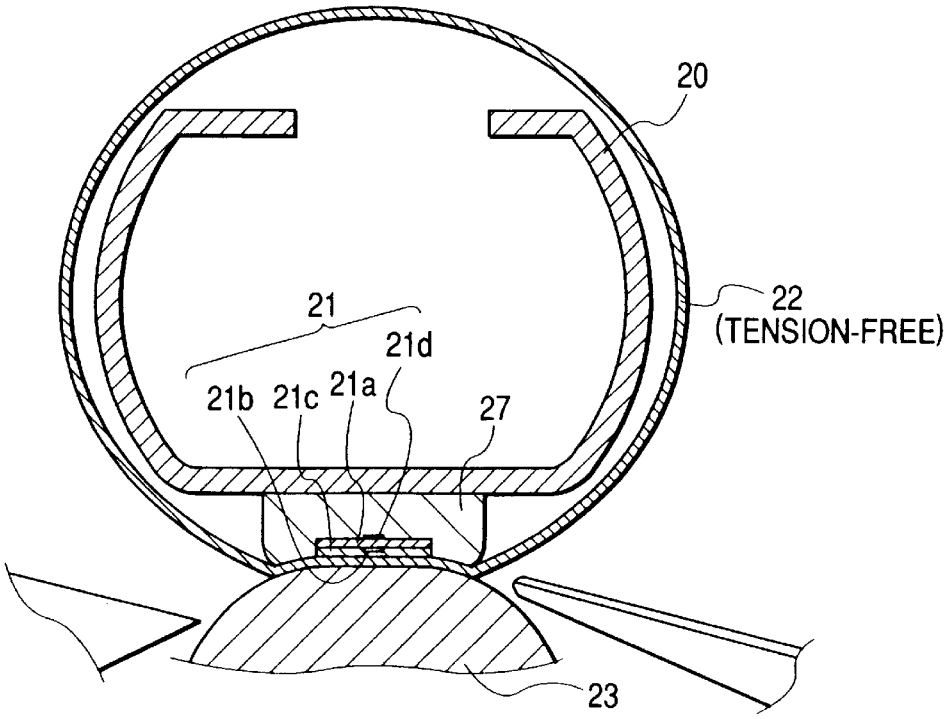
FIG. 4 is a transverse cross-sectional view of the main part of a fixing assembly applicable in the image-forming method of the present invention, showing how a film stands when the assembly is not driven.

As the heat-and-pressure fixing means, besides the heat roll system as shown here, constituted basically of a heat roller and a pressure roller, a system in which the toner image is heat-fixed by means of a heater through a film may also be used because the toner of the present invention shows good matching thereto. A system of this type is specifically shown in FIGS. 3 and 4. Film end regulation flanges 25 support right-and-left both ends of a fixing film 22. Inside the cylindrical, fixing film 22, a stay 20 is disposed and, integrally with feeder connectors 26 and disconnection members 27, a heating member 21 is installed to make up a fixing heat section. The film end regulation flanges 25 cause a press-down force to act on the stay 20 by the action of coil springs 24 provided between flanges and spring receiving members (not shown). Thus, a fixing nip with a given width is formed between the under surface of the fixing film 22 and the top surface of the pressure roller 23. The heating member 21 consists of a heater substrate 21*a*, a heating element 21*b*, a surface protective layer 21*c* and a temperature detector 21*d*. The pressure roller 23 is a pressure roller having a foam such as silicone rubber as a lower layer. In the fixing film 22, a heat-resistant film may preferably be used at its surface coming into contact with the transfer medium. As the heat-resistant film, stated specifically, usable is a film formed of a resin such as PTFE with a conductive material dispersed therein and having a thickness for having a low-resistance release layer.

Accordingly, in the heat fixing step a film can be interposed between the transfer medium and the heating member.

For example, surface temperature detector of the temperature detector 21*d* of the heating member 21 is set at 180° C., the total pressure between the heating member 21 and a spongy pressure roller 23 having a foam of silicon rubber in its lower layer is set at 6 kg, and the nip between the pressure roller 23 and the fixing film 22 is set at 8 mm. As the fixing film 22, a 60 $\mu$m thick heat-resistant polyimide film may be used which has on its side coming into contact with the transfer medium a low-resistance release layer formed of PTFE (of a high-molecular-weight type) having a conductive material dispersed therein.

Meanwhile, the transfer residual toner 213 not transferred and remaining on the photosensitive member 209 is passed through between the photosensitive member 209 and the charging roller 210, and again reaches the development nip portion, where it is collected in the developing assembly 200 by means of the toner carrying member 202 through the cleaning-at-development step. The transfer residual toner remaining on the photosensitive member after transfer is collected through the cleaning-at-development step in this way, where the toner thus collected is collected in the developing assembly and again used for development.

The image-forming method of the present invention may also be a full-color image-forming method making use of an intermediate transfer system, where the contact development system described above is preferably usable.

Figure 2A:
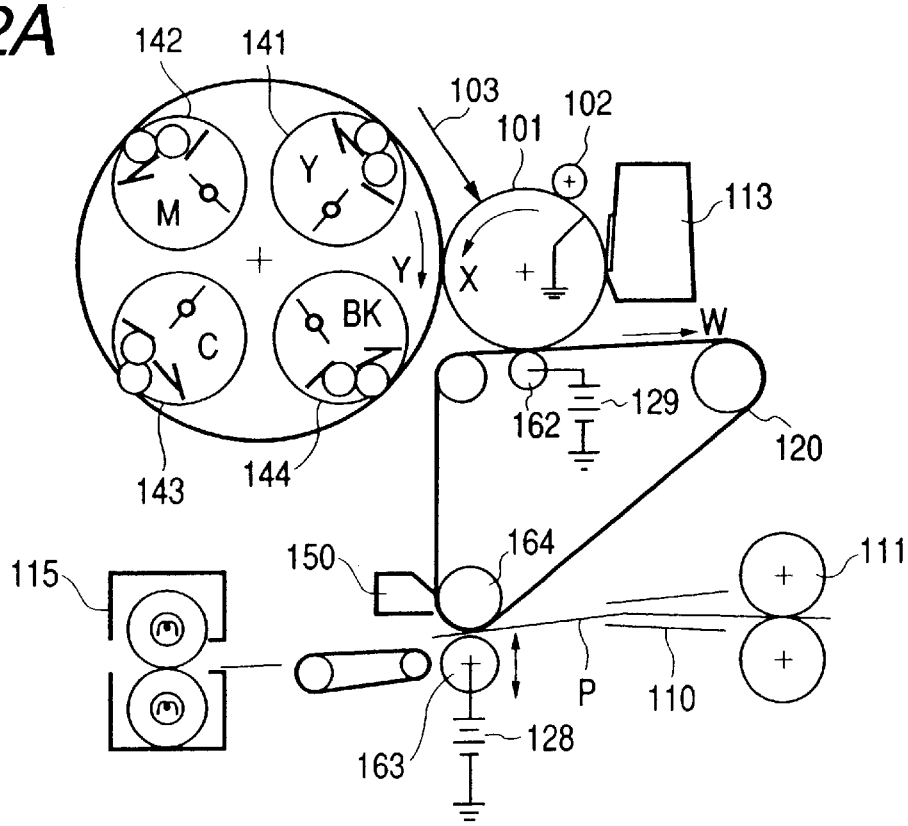
FIGS. 2A and 2B each schematically illustrate the construction of an image-forming apparatus employing an intermediate transfer belt, used to carry out the image-forming method of the present invention.
Figure 2B:
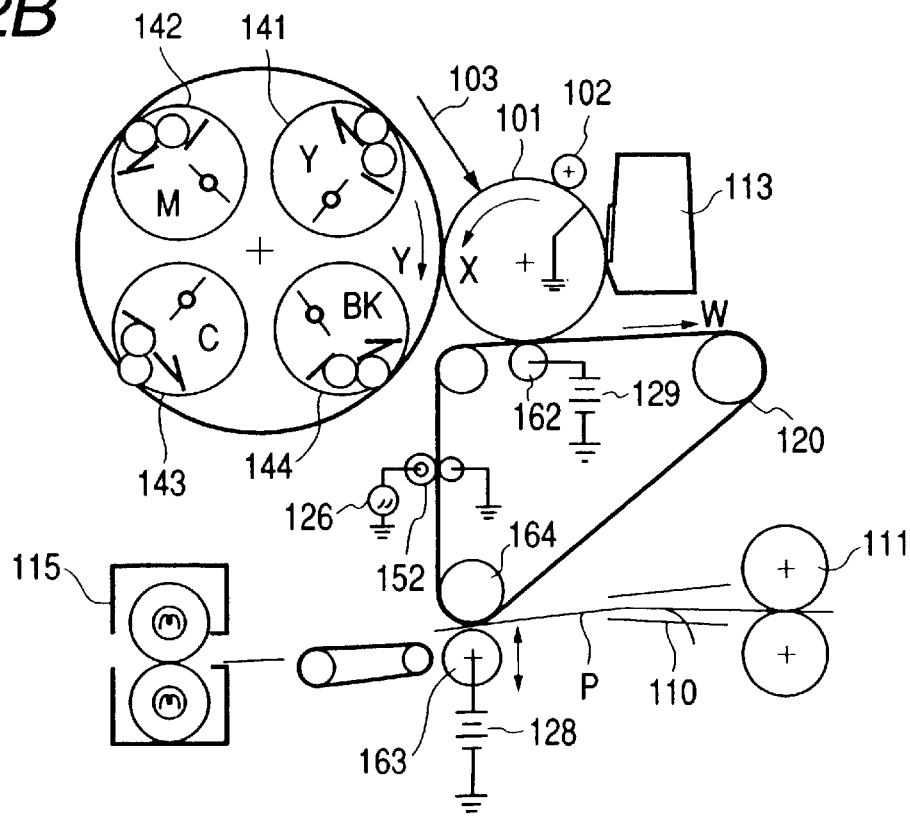

FIGS. 2A and 2B show examples of a color image-forming apparatus (a copying machine or a laser beam printer) making use of an intermediate transfer belt as an intermediate transfer member. Toners used in this image-forming method according to the present invention comprise the toner of the present invention described previously. Also, any other image-forming methods may be utilized which make use of the same apparatus as the above image-forming apparatus except for using the intermediate transfer belt.

A photosensitive drum 101 which is a drum type electrophotographic photosensitive member serving as first image bearing member (an electrostatic latent image bearing member) is rotatingly driven in the direction of an arrow X at a stated peripheral speed (process speed). The photosensitive drum 101 is, in the course of its rotation, uniformly charged to stated polarity and potential by means of a primary charging assembly 102, and then exposed to exposure light 103 by an imagewise exposure means (not shown). Thus, an electrostatic latent image is formed which corresponds to a first-color component image (e.g., a yellow component image) of the intended color image.

Next, this electrostatic latent image is developed by means of a first developing assembly (yellow developing assembly 141) into the first-color yellow component image). Here, second to fourth developing assemblies, i.e., a magenta developing assembly 142, a cyan developing assembly 143 and a black developing assembly 144 stand unoperated and do not act on the photosensitive drum 101, thus the first-color yellow component image is not affected by the second to fourth developing assemblies.

An intermediate transfer belt 120 is rotatingly driven in the direction of an arrow W at the same peripheral speed as the photosensitive drum 101.

The first-color yellow component image formed on the photosensitive drum 101 is, in the course it passes through a nip between the photosensitive drum 101 and the intermediate transfer belt 120, transferred to the periphery of the intermediate transfer belt 120 (primary transfer) by the aid of an electric filed formed by a primary transfer bias applied from a bias power source 129 to the intermediate transfer belt 120 via a primary transfer roller 162.

The surface of the photosensitive drum 101 from which the corresponding first-color yellow toner image has been transferred to the intermediate transfer belt 120 is cleaned by means of a cleaning assembly 113.

Subsequently, a second-color magenta toner image, a third-color cyan toner toner and a fourth-color black toner image are formed in the same way, and are sequentially superposingly transferred onto the intermediate transfer belt 120, thus a synthesized color toner image corresponding to the intended color image is formed.

A secondary transfer roller 163 is axially supported in parallel to a secondary transfer roller 164 and is provided at the under surface of the intermediate transfer belt 120 in a separable state.

The primary transfer bias for transferring the toner images from the photosensitive drum 101 to the intermediate transfer belt 120 is applied from a bias power source 129 in polarity reverse to that of the toners. This applied voltage may be in the range of, e.g., from +100 V to +2 kV.

When the first-color to third-color toner images are primarily transferred from the photosensitive drum 101 to the intermediate transfer belt 120, the secondary transfer roller 163 may be kept separate from the intermediate transfer belt 120. Where the apparatus has a transfer residual toner charging member 152 as shown in FIG. 2B, this is also kept separated from the intermediate transfer belt 120. Incidentally, to the transfer residual toner charging member 152, a voltage is kept applied from a bias power source 126.

A transfer medium P which is a second image bearing member is fed through a paper roller 111 at a given timing to the nip between the intermediate transfer belt 120 and the secondary transfer roller 163. Upon application of a secondary transfer bias to the secondary transfer roller 163 from a bias power source 128, toner images corresponding to a full-color image which have been transferred onto the intermediate transfer belt 120 are secondarily transferred to the transfer medium P. The transfer medium P to which the toner images have been transferred is guided to a fixing assembly 115 and heat-fixed there.

After the toner images have been transferred to the transfer medium P, a transfer residual toner cleaning assembly 150 is brought into contact with the intermediate transfer belt 120 and the surface of the intermediate transfer belt 120 is cleaned.

As the intermediate transfer member, an intermediate transfer drum may likewise be used in place of the intermediate transfer belt. An example thereof is given below.

The intermediate transfer drum is comprised of a pipe-like conductive mandrel and a medium-resistance elastic material layer formed on its periphery. The mandrel may comprise a plastic pipe provided thereon with a conductive coating.

The medium-resistance elastic material layer is a solid or foamed-material layer made of an elastic material such as silicone rubber, Teflon rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer drum is provided in contact with the bottom part of the electrostatic latent image bearing member, being axially supported in parallel to the electrostatic latent image bearing member 1, and is rotated at the same peripheral speed as the electrostatic latent image bearing member in the same direction or opposite direction.

A transfer assembly is provided in contact with the bottom part of the intermediate transfer drum, being axially supported in parallel to the intermediate transfer drum. The transfer assembly is, e.g., a transfer roller or a transfer belt, and is rotated at the same peripheral speed as the intermediate transfer drum and in the same direction at their contact zone.

The transfer assembly is so provided that it comes into direct contact with the intermediate transfer drum. In the case of the transfer roller, it is basically comprised of a mandrel at the center and a conductive elastic layer that forms the periphery of the former.

The intermediate transfer drum and the transfer roller may be formed of commonly available materials. The elastic layer of the transfer roller may be set to have a smaller volume resistivity, whereby the voltage applied to the transfer roller can be lessened, good toner images can be formed on the transfer medium and also the transfer medium can be prevented from being wound around the intermediate transfer drum. In particular, the elastic layer of the intermediate transfer drum may preferably have a volume resistivity at least 10 times the volume resistivity of the elastic layer of the transfer roller.

For example, a conductive elastic layer of the transfer roller is made of, e.g., an elastic material having a volume resistivity of $10^5$ to $10^{10}$ Ω·cm, such as polyurethane, or an ethylene-propylene-diene type terpolymer (EPDM), with a conductive material such as carbon dispersed therein. A bias is applied to the mandrel of the transfer roller from a low-voltage power source. As bias conditions, a voltage of from 0.2 to 10 kV is preferred.

In the foregoing, described are the one-component development image-forming method having a cleaning-at-development step and the image-forming method of an intermediate transfer system employing the image-forming apparatus having an intermediate transfer belt or an intermediate transfer drum. The toner of the present invention may preferably be used also in image-forming methods other than the above.

EXAMPLES

The present invention will be described below in greater detail. The present invention should by no means construed limitative to these Examples.

In the following formulation, part(s) is part(s) by weight in all occurrences.

1. Production of Diene-monomer-containing Resin

Diene-monomer-containing resins 1 to 10 were produced in the following way.

Production of Diene-monomer-containing Resin 1

In a vacuum-drawable reactor, 80 parts by weight of styrene, 1 part by weight of 2,2'-azobisisobutyronitrile and 500 parts by weight of benzene were added, and 20 parts by weight of 1,3-butadiene was charged thereinto by distillation through a liquefaction meter. Then, vacuum deaeration was repeated until bubbles of dissolved air came no longer to be seen, and the mixture obtained was heat-sealed in a tube in vacuum. This was polymerized with shaking in a 60° C. thermostatic chamber. After the polymerization, the sealed tube was opened and its contents were poured into methanol to effect reprecipitation. The supernatant formed was decanted, and the precipitate was washed with methanol, followed by drying under reduced pressure for 24 hours at 40° C. and 200 Pa (1.5 mmHg) to obtain a styrene-butadiene copolymer (diene-monomer-containing resin 1). Compositional ratio of this polymer was determined in the following way. As the result, styrene/butadiene was in weight ratio of 80/20. Mixing proportion of materials is shown in Table 1 and characteristic values are shown in Table 2.

The content of the component derived from the diene monomer was measured by $^1$H-NMR in the following way.

A polymer well washed and then dried is weighed in an amount of from 50 to 100 mg, and is dissolved for 24 hours in 1.0 ml of a deuterated solvent containing 1% by volume of tetramethylsilane. After insoluble matter is optionally removed using a membrane filter, the sample is put in a sample tube of 10 mm in diameter and the content is measured with an FT-NMR instrument JNM-EX400 (manufactured by Nippon Denshi K.K.).

Production of Diene-monomer-containing Resin 2

A diene-monomer-containing resin 2 was obtained in the same manner as in Production of Diene-monomer-containing Resin 1 except that the type and amount of the monomer used were changed as shown in Table 1. Its characteristic values are shown in Table 2.

Production of Diene-monomer-containing Resin 3

Into a pressure bottle fitted with a septum cap, 126 parts by weight of water, 3.3 parts by weight of disproportionated potassium rhodinate, 0.07 part by weight of sodium salt of a condensation product of naphthalenesulfonic acid with formalin, 0.07 part by weight of tetraethylenepentamine, 50 parts by weight of styrene and 0.17 part by weight of tertiary dodecylmercaptan were charged, and 9 parts by weight of isoprene was further charged using a liquefaction meter, where 2 parts by weight of the isoprene was vaporized to drive off the inside air and then the bottle was stoppered. This bottle was attached to a rotating plate of a 5° C. rotary polymerization bath to carry out stirring for 30 minutes. Thereafter, using a syringe, a solution of 0.1 part by weight of cumene hydroperoxide and 3.5 parts by weight of styrene was injected to initiate polymerization. After 72 hours, 3.5 parts by weight of an aqueous 10% solution of sodium dimethyldithiocarbamate was injected to stop polymerization, and steam was blown into the system to drive off unreacted monomers. After addition of phenyl-6-naphthylamine corresponding to 2% of the copolymer formed, 25% brine and subsequently 1% sulfuric acid were poured into it to solidify the copolymer, which was then washed with water and thereafter dried to obtain a diene-monomer-containing resin 3. Its characteristic values are shown in Table 2.

Production of Diene-monomer-containing Resin 4

A diene-monomer-containing resin 4 was obtained in the same manner as in Production of Diene-monomer-containing Resin 3 except that the type and amount of the monomer used were changed as shown in Table 1. Its characteristic values are shown in Table 2.

Production of Diene-monomer-containing Resin 5

85 parts by weight of styrene, 15 parts by weight of butadiene, 5 parts by weight of sodium salt of a fatty acid and 200 parts by weight of ion-exchange water were put into a polymerization vessel autoclave. Next, 3.5 parts by weight of n-dodecylmercaptan and 0.2 part by weight of potassium persulfate were added to effect emulsion polymerization for 15 hours at 50° C. to obtain a diene-monomer-containing resin 5. Its characteristic values are shown in Table 2.

Production of Diene-monomer-containing Resin 6

Into a 30-liter autoclave, 114 parts by weight of sodium benzilate, 368 parts by weight of toluene and 9,900 parts by weight of n-hexane were charged in a stream of nitrogen, and were kept at 30° C. Thereafter, 8,185 parts by weight of butadiene was dropwise added over a period of 2 hours while the temperature was kept at 30° C., and then 200 parts by weight of methanol was added to stop polymerization. Next, 1,000 parts by weight of clay was added, and the mixture was vigorously stirred, followed by filtration to obtain a transparent polymer solution containing no alkali. Then, from this polymer solution, unreacted butadiene, the toluene and the n-hexane were evaporated off, thus a diene-monomer-containing resin 6 having a number-average molecular weight of 1.900 was synthesized. Its characteristic values are shown in Table 3.

Production of Diene-monomer-containing Resin 7

1,000 parts by weight of the diene-monomer-containing resin 6, 150 parts by weight of maleic anhydride, 300 parts by weight of xylene and 2 parts by weight of Antigen 3C (trade name; available from Sumitomo Chemical Co., Ltd.) were charged into a 2-liter autoclave, and reaction was carried out at 190° C. for 8 hours in a stream of nitrogen. Next, unreacted maleic anhydride and the xylene were evaporated off under reduced pressure, thus maleated polybutadiene (diene-monomer-containing resin 7) having a number-average molecular weight of 2,000 was synthesized.

The greater part of the acid groups of the maleated polybutadiene has a structure represented by the following formula (IV).

(IV)

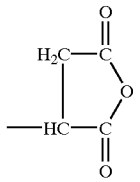

It also contains groups having a structure represented by the following formula (V), hydrolyzed by water contained partly in air and in the solvent and so forth.

(V)

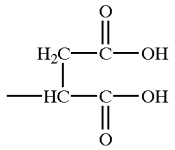

Characteristic values of the diene-monomer-containing resin 7 are shown in Table 3.

Production of Diene-monomer-containing Resin 8

A diene-monomer-containing resin 8 was obtained in the same manner as in Production of Diene-monomer-containing Resin 6 except that the butadiene in the materials used therein was replaced with 6,500 parts by weight of isoprene. Its characteristic values are shown in Table 3.

Production of Diene-monomer-containing Resin 9

Into a 2-liter reactor provided with a jacket having a condenser, a peracetic acid feed inlet and an $N_2$ feed pipe, 400 parts by weight of an ethyl acetate solution of 46.3% as solid content of the diene-monomer-containing resin 8 was charged. Next, to 280 parts by weight of peracetic acid (30%, ethyl acetate solution), 0.2 part by weight of sodium 2-ethylhexyltripolyphosphate was added to effect dissolution. Thereafter, a peracetic acid solution was dropwise added over a period of about 4 hours while the reaction temperature was maintained at 50° C. The temperature was thereafter maintained at 50° C. for further 6 hours.

Next, 680 parts by weight of purified water was added, and the mixture obtained was stirred for 30 minutes and thereafter allowed to stand at 50° C. On lapse of 30 minutes thereafter, the aqueous phase separated was drawn out little by little. Then, 300 parts by weight of ethyl acetate was added, and 800 parts by weight of purified water was further added, followed by stirring for 30 minutes. Thereafter, the resultant mixture was allowed to stand at 30 minutes while the temperature was maintained at 50° C., and the aqueous phase formed was drawn out. Then, 700 parts by weight of purified water was further added, and the mixture was stirred at 50° C. for 30 minutes, which was then allowed to stand at 50° C. for 30 minutes, and the aqueous phase formed was drawn out to obtain 650 parts by weight of an ethyl acetate solution having 30.1% of solid content.

Subsequently, the upper-layer solution obtained was charged into a thin-film type evaporator under conditions of 50° C., 2,700 to 6,700 Pa (20 to 50 mmHg) and 300 ml/h, thus 180 parts by weight of the desired diene-monomer-containing resin 9, having epoxy groups, was obtained. Its characteristic values are shown in Table 3.

Production of Diene-monomer-containing Resin 10

In a 2-liter reactor provided with a jacket having a condenser and an $N_2$ feed pipe, 150 parts by weight of glycidyl methacrylate was added to 1,150 parts by weight of the diene-monomer-containing resin 7 having been synthesized. These were heated to 60° C. and reacted for 12 hours in the reactor, to obtain 1,300 parts by weight of a diene-monomer-containing resin 10. Its characteristic values are shown in Table 3.

2. Production of Resin Used in Combination With Diene-monomer-containing Resin

Resins 1 and 2 were produced in the following way.

Production of Resin 1

Into a separable flask made of glass, fitted with a thermometer, a stainless steel stirring rod, a flow-down type condenser and a nitrogen feed pipe, 200 parts by weight of xylene was put and the temperature was raised to reflux temperature. To this, a mixture solution of 80 parts by weight of styrene, 20 parts by weight of n-butyl acrylate and 2.3 parts by weight of di-tert-butyl peroxide was dropwise added. Thereafter, under reflux of xylene, solution polymerization was completed in 7 hours to obtain a low-molecular weight resin solution.

Meanwhile, 65 parts by weight of styrene, 25 parts by weight of butyl acrylate, 10 parts by weight of monobutyl maleate, 0.2 part by weight of polyvinyl alcohol, 200 parts by weight of deaerated water and 0.5 part by weight of benzoyl peroxide were mixed, suspended and dispersed. The suspension dispersion obtained was heated, and was kept at 85° C. for 24 hours in an atmosphere of nitrogen to complete polymerization, thus a high-molecular weight resin was obtained.

30 parts by weight of the high-molecular weight resin was introduced into the above low-molecular weight resin solution, containing 70 parts by weight of low-molecular weight resin, and these were completely dissolved in a solvent to carry out mixing, followed by evaporation-off of the solvent to obtain a resin 1.

Analysis of the resin 1 revealed that its low-molecular weight side peak molecular weight was 10,000, high-molecular weight side peak molecular weight was 560,000, weight-average molecular weight (Mw) was 300,000 and number-average molecular weight (Mn) was 55,000. Also, its glass transition temperature was 55° C.

Production of Resin 2

A low-molecular weight resin solution was obtained in the same manner as in Production of Resin 1.

Meanwhile, 75 parts by weight of styrene, 25 parts by weight of butyl acrylate, 0.2 part by weight of polyvinyl alcohol, 200 parts by weight of deaerated water and 0.5 part by weight of benzoyl peroxide were mixed, suspended and dispersed. The suspension dispersion obtained was heated, and was kept at 85° C. for 24 hours in an atmosphere of nitrogen to complete polymerization, thus a high-molecular weight resin was obtained.

30 parts by weight of the high-molecular weight resin was introduced into the above low-molecular weight resin solution, containing 70 parts by weight of low-molecular weight resin, and these were completely dissolved in a solvent to carry out mixing, followed by evaporation-off of the solvent to obtain a resin 2.

Analysis of the resin 2 revealed that its low-molecular weight side peak molecular weight was 12,000, high-molecular weight side peak molecular weight was 580,000, weight-average molecular weight (Mw) was 300,000 and number-average molecular weight (Mn) was 55,000. Also, its glass transition temperature was 55° C.

3. Production of Toner

Toners 1 to 12 of the present invention and comparative toners 1 to 6 for comparison were produced in the following way.

Production of Toner 1

| | (by weight) |
|---|---|
| Resin 1 | 100 parts |
| Diene-monomer-containing resin 1 | 10 parts |
| Carbon black (BET specific surface area: 90 $m^2/g$) | 10 parts |
| Negative charge control agent [the compound of Formula (II)] | 2 parts |
| Low-molecular weight polyethylene (maximum value of endothermic peak: 115° C.) | 5 parts |

The above materials were mixed using a blender, and the mixture obtained was melt-kneaded by means of a twin-screw extruder heated to 160° C. The resultant kneaded product, having been cooled, was crushed with a hammer mill. Thereafter, the crushed product was finely pulverized using a jet mill. Then, the resultant particles were treated to make surface modification by means of an apparatus comprising a rotor rotated to impart a mechanical impact force. The particles thus obtained were classified to obtain a classified powder 1.

Meanwhile, into a 2-liter four-necked flask having a high-speed stirrer TK-type homomixer (manufactured by Tokushu Kika Kogyo), 650 parts of ion-exchanged water and 500 parts of an aqueous 0.1 mol/liter $Na_3PO_4$ solution were introduced, and the mixture was heated to 70° C. with stirring by means of the stirrer at a number of revolution adjusted to 12,000 rpm. Then, 80 parts of an aqueous 0.1 mol/liter $CaCl_2$ solution was added thereto to prepare an aqueous dispersion medium containing fine-particle slightly water-soluble dispersion stabilizer (calcium phosphate).

To this aqueous dispersion medium, containing the dispersion stabilizer, 127 parts by weight of the above classified powder 1 was slowly added. The mixture formed was heated to 60° C. and this temperature was kept, where a dispersion prepared by ultrasonic-dispersing 0.7 part by weight of t-butyl peroxyneodecanoate in 0.01 part by weight of sodium dodecylbenzenesulfonate and 20 parts by weight of ion-exchanged water was added thereto over a period of 5 minutes. Thereafter, the mixture obtained was kept at the same temperature for 5 hours to carry out reaction. After the reaction was completed, the resultant suspension was cooled, and then dilute hydrochloric acid was added to remove the dispersion stabilizer, which was then further washed with water repeatedly several times, followed by drying to obtain reaction-treated particles A.

100 parts by weight of the above reaction-treated particles A and 1.2 parts by weight of a hydrophobic fine silica powder (BET specific surface area: 240 $m^2/g$) treated with silicone oil was dry-process mixed by means of a Henschel mixer to obtain a toner 1 of the present invention.

The toner 1 had an average circularity of 0.953, a circularity standard deviation of 0.039, a circularity-corresponding number-average particle diameter D1 of 5.3 $\mu$m, a high-molecular weight side peak molecular weight of 580,000 and a low-molecular weight side peak molecular weight of 11,000.

Production of Toner 2

Toner 2 was obtained in the same manner as in Production of Toner 1 except for changing the type and amount of the binder resin. The types and amounts of materials used are shown in Table 4, and the results of analysis of the toner are shown in Table 7.

Production of Toner 3

Into a 2-liter four-necked flask having a high-speed stirrer TK-type homomixer (manufactured by Tokushu Kika Kogyo), 650 parts of ion-exchanged water and 500 parts of an aqueous 0.1 mol/liter $Na_3PO_4$ solution were introduced, and the mixture was heated to 70° C. with stirring by means of the stirrer at a number of revolution adjusted to 12,000 rpm. Then, 80 parts of an aqueous 1.0 mol/liter $CaCl_2$ solution was added thereto to prepare an aqueous dispersion medium containing fine-particle slightly water-soluble dispersion stabilizer (calcium phosphate).

Meanwhile, as a disperse phase (dispersoid), the following was prepared.

| | (by weight) |
|---|---|
| Styrene | 82 parts |
| 2-Ethylhexyl acrylate | 18 parts |
| Carbon black (BET specific surface area: 90 $m^2/g$) | 10 parts |
| Diene-monomer-containing resin 1 | 10 parts |
| Wax (ester wax; maximum value of endothermic peak: 76° C.) | 7 parts |
| Negative charge control agent [the compound of Formula (II)] | 2 parts |

A mixture of the above materials was dispersed for 3 hours by means of an attritor (manufactured by Mitsui Kinzoku Corporation), followed by addition of 3 parts by weight of 2,2'-azobis(2,4-dimethylvaleronitrile) to prepare a polymerizable monomer composition.

Next, the polymerizable monomer composition was introduced into the above aqueous dispersion medium to granulate the polymerizable monomer composition in an atmosphere of nitrogen at an internal temperature of 70° C. with stirring for 10 minutes while the number of revolution of the high-speed stirrer was maintained at 12,000 rpm. Thereafter, the stirrer was changed to a stirrer having propeller stirring blades and the system was kept at the same temperature for 2 hours with stirring at 50 rpm. At this point of time, a solution prepared by dissolving 0.4 part by weight of potassium persulfate in 20 parts by weight of ion-exchanged water was added over a period of 5 minutes, which was further kept at the same temperature for 8 hours to complete polymerization. The conversion of polymerization reaction at the time of adding the potassium persulfate was 43%.

After the polymerization was completed, the resultant suspension was cooled, and then dilute hydrochloric acid was added to remove the dispersion stabilizer, which was then further washed with water repeatedly several times, followed by drying to obtain polymer particles 3. The polymer particles 3 had a weight-average particle diameter of 6.8 μm.

100 parts by weight of the above polymer particles 3 and 1.5 parts by weight of a hydrophobic fine silica powder (BET specific surface area: 240 $m^2/g$) treated with silicone oil was dry-process mixed by means of a Henschel mixer to obtain a toner 3 of the present invention.

The toner 3 had an average circularity of 0.989, a circularity standard deviation of 0.021, a circularity-corresponding number-average particle diameter D1 of 5.5 μm and a peak molecular weight of 26,000.

Production of Toners 4 to 10

Toners 4 to 10 were obtained in the same manner as in Production of Toner 3 except for changing the type and amount of the binder resin and the reaction temperature at the time of reaction treatment. The types and amounts of materials used are shown in Table 5, and the results of analysis of the toner are shown in Table 7.

Production of Toners 11 and 12

Toners 11 and 12 were obtained in the same manner as in Production of Toner 3 except for changing the type and amount of the binder resin and the reaction temperature at the time of reaction treatment and also except that a dispersion prepared by ultrasonic-dispersing each of organic peroxides shown in Table 5 in 0.01 part by weight of sodium dodecylbenzenesulfonate and stated (in Table 5) parts by weight of ion-exchanged water was added thereto over a period of 5 minutes at the time of the conversion of polymerization reaction shown in Table 5. The types and amounts of materials used are shown in Table 5, and the results of analysis of the toner are shown in Table 7.

Production of Comparative Toner 1

Comparative Toner 1 was obtained in the same manner as in Production of Toner 1 except for changing the type and amount of the materials. The types and amounts of materials used are shown in Table 4, and the results of analysis of the toner are shown in Table 7.

Production of Comparative Toner 2

Comparative Toner 2 was obtained in the same manner as in Production of Toner 1 except for changing the type and amount of the materials and not making any reaction treatment with the initiator. The types and amounts of materials used are shown in Table 4, and the results of analysis of the toner are shown in Table 7.

Production of Comparative Toners 3 to 6

Comparative Toners 3 to 6 were obtained in the same manner as in Production of Toner 3 except for changing the type and amount of the materials. The types and amounts of materials used are shown in Table 6, and the results of analysis of the toner are shown in Table 7.

Production of Comparative Toner 7

Into a 2-liter four-necked flask having a high-speed stirrer TK-type homomixer (manufactured by Tokushu Kika Kogyo), 650 parts of ion-exchanged water and 500 parts of an aqueous 0.1 mol/liter $Na_3PO_4$ solution were introduced, and the mixture was heated to 70° C. with stirring by means of the stirrer at a number of revolution adjusted to 12,000 rpm. Then, 80 parts of an aqueous 1.0 mol/liter $CaCl_2$ solution was added thereto to prepare an aqueous dispersion medium containing fine-particle slightly water-soluble dispersion stabilizer (calcium phosphate).

Meanwhile, as a disperse phase (dispersoid), the following was prepared.

| | (by weight) |
|---|---|
| Styrene | 82 parts |
| 2-Ethylhexyl acrylate | 18 parts |
| Carbon black (BET specific surface area: 90 $m^2/g$) | 10 parts |
| Unsaturated polyester resin | 10 parts |
| Wax (ester wax; maximum value of endothermic peak: 76° C.) | 7 parts |
| Negative charge control agent [the compound of Formula (II)] | 2 parts |

A mixture of the above materials was dispersed for 3 hours by means of an attritor (manufactured by Mitsui Kinzoku Corporation), followed by addition of 3 parts by weight of 2,2'-azobis(2,4-dimethylvaleronitrile) to prepare a polymerizable monomer composition.

Next, the polymerizable monomer composition was introduced into the above aqueous dispersion medium to granulate the polymerizable monomer composition in an atmosphere of nitrogen at an internal temperature of 70° C. with stirring for 10 minutes while the number of revolution of the high-speed stirrer was maintained at 12,000 rpm. Thereafter, the stirrer was changed to a stirrer having propeller stirring blades and the system was kept at the same temperature for 2 hours with stirring at 50 rpm. At this point of time, a polymerizable monomer composition prepared by dissolving 8.2 parts by weight of styrene monomer, 1.8 parts by weight of n-butyl acrylate, 2.5 parts by weight of unsaturated polyester and 0.4 part by weight of potassium persulfate in 40 parts by weight of ion-exchanged water was added over a period of 60 minutes, which was further kept at the same temperature for 8 hours to complete polymerization. The conversion of polymerization reaction at the time of adding the polymerizable monomer composition was 60%.

After the polymerization was completed, the resultant suspension was cooled, and then dilute hydrochloric acid was added to remove the dispersion stabilizer, which was then further washed with water repeatedly several times, followed by drying to obtain polymer particles 7. The polymer particles 7 for comparison had a weight-average particle diameter of 7.0 μm.

100 parts by weight of the above polymer particles 7 and 1.5 parts by weight of a hydrophobic fine silica powder (BET specific surface area: 240 $m^2/g$) was dry-process mixed by means of a Henschel mixer to obtain a comparative toner 7.

The comparative toner 7 had an average circularity of 0.975, a circularity standard deviation of 0.031, a circularity-corresponding number-average particle diameter Dl of 5.8 μm and a peak molecular weight of 30,000. The results of analysis of the toner are shown in Table 7.

Example 1

Toners 1 to 12 of the present invention and comparative toners 1 to 7 for comparison, thus obtained, were evaluated in the following way.

An image-forming apparatus used in the present Example is described first. In the present Example, a commercially available laser beam printer LBP-PX (manufactured by CANON INC.) was remodeled for non-magnetic one-component development and put into use. This image-forming apparatus is described with reference to FIG. 1.

In the present Example, used was a reverse development apparatus in which negative (negative polarity) latent images formed on a photosensitive member are developed with a negatively chargeable (negative polarity) toner.

FIG. 1 cross-sectionally schematically illustrates the laser beam printer applied in the present invention. An OPC photosensitive drum 10 (diameter: 24 mm) is rotated in the direction of an arrow and is uniformly so charged by a charging roller 11 as to have a dark-area potential (Vd) of −600 V. Then, its image-froming area was exposed to light by means of an exposure assembly, so that an electrostatic latent image having a light-area potential (Vl) of −150 V was formed. A toner-carrying member 17 having a toner-coating roller 16 and the photosensitive drum 10 were so set that the former's toner layer and the latter's surface did not come in contact, leaving a distance of 300 μm. Image areas were developed with a negatively chargeable toner T while an AC bias (f: 1,800 Hz; Vpp: 1,400 V) and a DC bias (Vdc: −400 V) were applied to the toner-carrying member 17 by a bias applying means V, to form a toner image on the photosensitive drum 10.

The toner image thus formed is transferred to a transfer medium P by means of a transfer roller 19, and the toner having remained on the surface of the photosensitive drum 10 is removed by cleaning by means of a cleaner 13. Meanwhile, the transfer medium P separated from the photosensitive drum 10 is subjected to heat fixing treatment by means of a heat fixing assembly H in order to fix the toner image onto the transfer medium P.

The above steps are repeated to form images. Here, as the heat fixing assembly H, the one shown in FIGS. 3 and 4 was used. The surface temperature of a temperature detector 21*d* of a heater 21 was set at 190° C., the total pressure between the heating element 21 and the pressure roller 23 was set to be 6 kg, and the nip between the pressure roller 23 and the fixing film 22 was set to be 3 mm. As the fixing film 22, a 50 μm thick heat-resistant polyimide film was used which had on its side coming into contact with the transfer medium a low-resistance release layer formed of PTFE having a conductive material dispersed therein.

The toner-carrying member had a surface roughness Ra (μm) of 1.5 and the toner layer thickness regulation blade was made of stainless steel.

In the present Example, using the above image-forming apparatus shown in FIG. 1, a 5,000-sheet printing test was made in environments of normal temperature and normal humidity (25° C., 60%RH), high temperature and high humidity (30° C., 80%RH) and low temperature and low humidity (15° C., 10%RH) at a printing rate of 28 sheets (A4-size)/minute in an intermittent mode (i.e., a mode in which the developing assembly was made to pause for 10 seconds every time the images were printed on one sheet so that the deterioration of the toner was accelerated by preliminary operation of the developing assembly when again driven), using each of the toners 1 to 12 of the present invention and the comparative toners 1 to 7. Then, printed images obtained were evaluated in respect of the following items.

Printed-Image Evaluation (1) Image Density:

Evaluated by image density measured upon finish of the 5,000-sheet printing test, made using sheets of usual plain paper (75 g/m$^2$) for copying machines. The image density was measured with MACBETH REFLECTION DENSITOMETER (manufactured by Macbeth Co.), as relative density with respect to an image printed on a white ground area with a density of 0.00 of an original.

A: 1.40 or more.

B: From 1.35 to less than 1.40.

C: From 1.00 to less than 1.35.

D: Less than 1.00.

(2) Image Fog:

Fog density (%) was calculated from a difference between the whiteness at a white background area of printed images at the time the printing test was finished and the whiteness of the transfer medium to make evaluation on image fog, which was measured with REFLECTOMETER MODEL TC-6DS (manufactured by Tokyo Denshoku Co., Ltd.). A a filter, a green filter was used. It means that, the smaller the value is, the less the fog is.

A: Less than 1.5%.

B: From 1.5% to less than 2.5%.

C: From 2.5% to less than 4.0%.

D: More than 4.0%.

(3) Halftone Image uniformity:

Image quality of printed images at the time the printing test was finished was evaluated according to the following criteria.

A: Very good.

B: Though slightly coarse, good images.

C: Though slightly coarse, on the level not problematic in practical use.

C: Seriously coarse images.

(4) Fixing Performance:

Fixing performance was evaluated as a rate (%) of decrease in image density before and after fixed images were rubbed five times with a soft thin paper under application of a load of 50 g/cm$^2$.

A: Less than 5%.

B: From 5% to less than 10%.

C: From 10% to less than 20%.

D: More than 20%.

(5) Anti-offset Properties:

Anti-offset properties were evaluated by the degree of stains seen on images after 5,000 sheet printing where a sample image with an image area percentage of about 5% was printed.

A: No stains appears.

B: Stains are slightly seen.

C: Stains are seen to some degree.

D: Stains are greatly seen.

The results of evaluation on these are shown Table 8.

Example 2

Toners 3 to 12 of the present invention and comparative toners 3 to 7 for comparison, obtained in the toner production examples given previously, were evaluated in the following way.

First, as an image forming apparatus, an apparatus having the same construction as the image-forming apparatus shown in FIG. 5 in the Description of The Preferred Embodiments was used as an image-forming apparatus of Example 2. Stated specifically, it is as follow:

A 600 dpi laser printer (LBP-860, manufactured by CANON INC.) was made ready for testing, and was remodeled to have a process speed of 60 mm/sec.

From a process cartridge of this printer, a cleaning rubber blade was detached. Its charging system was changed for the direct charging system in which a rubber roller is brought into contact with its electrostatic latent image bearing member (photosensitive member), and a voltage of a DC component (−1,200 V) was applied. Next, the developing part of the process cartridge was modified. A medium-resistance rubber roller (diameter: 16 mm; hardness: ASKER C 45 degrees; resistance: $10^5$ Ω·cm) formed of silicone rubber with carbon black dispersed therein was used in place of a stainless steel sleeve, and was brought into contact with the photosensitive member. Here, their development contact (nip) width was set at about 3 mm. The toner-carrying member was so driven that it was rotated in the same direction as the photosensitive member at the former's part coming into contact with the latter and its rotational peripheral speed was 150% with respect to the rotational peripheral speed of the photosensitive member.

As the photosensitive member used here, a photosensitive member was prepared in which an aluminum cylinder of 30 mm diameter and 254 mm long was used as a substrate and layers with constitution as shown below were sequentially formed thereon in layers by dip coating.

(1) Conductive coating layer: Composed chiefly of powders of tin oxide and titanium oxide dispersed in phenol resin. Layer thickness: 1.5 μm.

(2) Subbing layer: Composed chiefly of a modified nylon and a copolymer nylon. Layer thickness: 0.6 μm.

(3) Charge generation layer: Composed chiefly of a titanyl phthalocyanine pigment having absorption in long wavelength range, dispersed in butyral resin. Layer thickness: 0.6 μm.

(4) Charge transport layer: Composed chiefly of a hole-transporting triphenylamine compound dissolved in polycarbonate resin (molecular weight: 20,000 as measured by Ostwald viscometry) in weight ratio of 8:10. Layer thickness: 20 μm.

As a means for coating the toner on the toner-carrying member, a toner coating roller formed of a foamed urethane rubber was provided in contact with the toner-carrying member in the developing assembly. A voltage of about −550 V is applied to the coating roller. Also, for the purpose of coat layer control of the toner on the toner-carrying member, a resin-coated blade made of stainless steel was attached in such a way that it came in contact with the toner-carrying member at a pressure of about 20 g/cm as linear pressure. This is schematically shown in FIG. 5. The voltage applied at the time of development was changed to a DC component (−450 V) only.

The image forming apparatus was so modified and process conditions were so set as to fit such modifications of the process cartridge.

The apparatus thus remodeled makes use of a roller charging assembly (only DC is applied) to charge the electrostatic latent image bearing member uniformly. Subsequently to the charging, its image forming area is exposed to light to form an electrostatic latent image, which is then rendered visible by the use of the toner. Thereafter, the toner image thus formed is transferred to a transfer medium by the aid of a roller to which a voltage is kept applied. The apparatus embodies such a process.

With regard to the charge potential of the photosensitive member, its dark-area potential was set at −600 V, and light-area potential at −150 V. Paper of 75 g/m$^2$ in basis weight was used as transfer mediums.

Using the above image-forming apparatus and using the toners 3 to 12 of the present invention and the comparative toners 3 to 7, a running test was made in an environment of 15° C. temperature/10% humidity.

To evaluate running performance, characters were printed in an print area percentage of 3%. Evaluation was made in the following way.

(1) Charging Roller Contamination by Toner:

Judged by the number of sheets on which any faulty images due to faulty charging caused by the contamination of charging member appeared on halftone images.

A: No appear until 3,000 sheets.
B: Appear from 2,700 sheets to less than 3,000 sheets.
C: Appear from 2,000 sheets to less than 2,700 sheets.
D: Appear less than 2,000 sheets.

(2) Toner Melt-adhesion to Photosensitive Member and Developing Sleeve:

At the stage where blank areas appeared on solid black images, the surfaces of the photosensitive member and developing sleeve were observed to examine whether or not the toner melt-adhered. Where no melt-adhesion was observable, the running test was continued.

A: No appear until 3,000 sheets.
B: Appear from 2,700 sheets to less than 3,000 sheets.
C: Appear from 2,000 sheets to less than 2,700 sheets.
D: Appear less than 2,000 sheets.

Where none of the charging roller contamination and the toner melt-adhesion to photosensitive member and developing sleeve occurred, the printing of images was continued on up to 3,000 sheets. It means that, the larger the number of sheets on which they occur is, the better running performance the toner has.

(3) Transfer Performance at the Initial Stage (on 100 Sheets):

Transfer residual toner remaining on the photosensitive member after transfer at the time of development of solid black images was taken off by taping with Mylar tape, and the tape with toner was stuck on white paper. From the Macbeth density measured thereon, the Macbeth density measured on tape alone (without toner) stuck on white paper was subtracted to obtain numerical values, according to which evaluation was made. Thus, the smaller the value is, the better the transfer performance is.

A: Less than 0.05.
B: From 0.05 to less than 0.10.
C: From 0.10 to less than 0.20.
D: Not less than 0.20.

Figure 7:
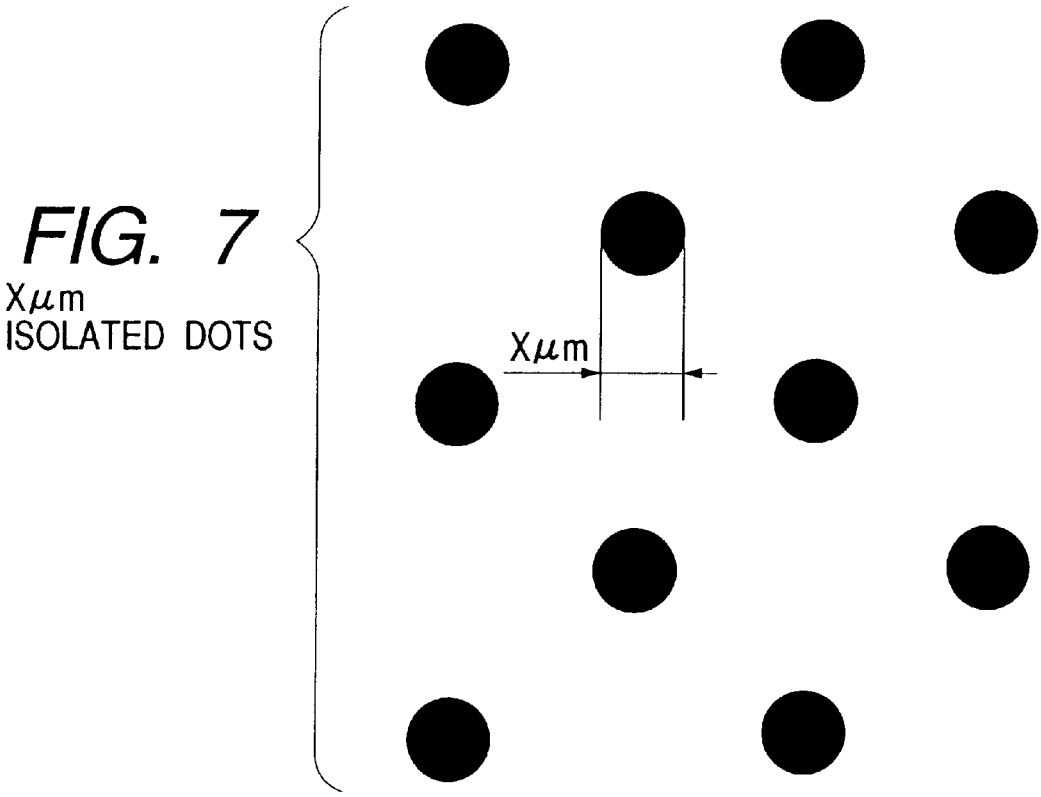
FIG. 7 illustrates a small-diameter isolated dot pattern used to examine developing performance of toners.

(4) Dot Reproducibility:

Images of a pattern of isolated dots of small diameter as shown in FIG. 7 (X=50 μm), which tend to form closed electric fields on account of latent image electric fields and are difficult to reproduce, were printed and the reproducibility of the dots was evaluated.

A: Missing dots are 2 or less per 100 dots.
B: Missing dots are 3 to 5 per 100 dots.
C: Missing dots are 6 to 10 per 100 dots.
D: Missing dots are 11 or more per 100 dots.

(5) Anti-offset Properties:

Any stains occurring on the back of image samples at the stages of from initial to 100-sheet running were observed to count the number of sheets where stains appeared.

A: No appear.
B: 1 to 2 sheets per 100 sheets.
C: 3 to 5 sheets per 100 sheets.
D: 6 sheets or more per 100 sheets.

(6) Fog:

Measured with REFLECTOMETER MODEL TC-6DS, manufactured by Tokyo Denshoku Co., Ltd. As a filter, a green filter was used. Fog density (%) was calculated from a difference between the whiteness at a white background area of printed images and the whiteness of the transfer medium to make evaluation on image fog. It means that, the smaller the value is, the less the fog is.

A: Less than 1.5%.
B: From 1.5% to less than 2.5%.
C: From 2.5% to less than 4.0%.
D: Not less than 4.0%.

The results of evaluation on these are shown in Table 9.

Example 3

Toner 5 of the present invention and comparative toner 6, obtained in the toner production examples given previously, were evaluated in the following way.

First, as an image forming apparatus, an apparatus having the same construction as the image-forming apparatus shown in FIGS. 2A and 2B in the Description of The Preferred Embodiments was used as an image-forming apparatus of Example 2. Stated specifically, it is as follow:

Surface movement speed of the toner-carrying member was so set as to be 150% with respect to the surface movement speed of the electrostatic latent image bearing member. As to toners 5 and 6, a 6,000-sheet printing test was made in environments of normal temperature and normal humidity (23° C., 65%RH) at a printing rate of 20 sheets (A4-size)/minute in a continuous mode (i.e., a mode in which the developing assembly was not paused so that the consumption of the toner was accelerated) in an print area percentage of 5%. Then the printed images obtained were examined to make evaluation on the items stated previously and any contamination of the intermediate transfer belt.

(7) Toner Melt-adhesion to Intermediate Transfer Belt, Photosensitive Member and Developing Sleeve:

At the stage where blank areas appeared on solid black images, the surfaces of the intermediate transfer belt, photosensitive member and developing sleeve were observed to examine whether or not the toner melt-adhered. Where no melt-adhesion was observable, the running test was continued.

A: No appear until 6,000 sheets.
B: Appear from 5,500 sheets to less than 6,000 sheets.
C: Appear from 5,000 sheets to less than 5,500 sheets.
D: Appear less than 5,000 sheets.

Results obtained are shown in Table 10.

TABLE 1

| | Diene monomer | | Other monomer | |
|---|---|---|---|---|
| Resin | Type | Amount (pbw) | Type | Amount (pbw) |
| Diene-monomer-containing resin 1 | Butadiene | 20 | Styrene | 80 |
| Diene-monomer-containing resin 2 | Butadiene | 25 | 4-Chlorostyrene | 75 |
| Diene-monomer-containing resin 3 | Isoprene | 12 | Styrene | 88 |
| Diene-monomer-containing resin 4 | Chloroprene | 30 | Styrene | 70 |
| Diene-monomer-containing resin 5 | Butadiene | 15 | Styrene | 85 |

TABLE 2

| | Compositional ratio in resin | | | |
|---|---|---|---|---|
| | Component derived from | Component derived from | Molecular weight distribution by GPC | |
| Resin | diene monomer | other monomer | Mn | Mw |
| Diene-monomer-containing resin 1 | 20 | 80 | 19,000 | 48,000 |
| Diene-monomer-containing resin 2 | 23 | 77 | 7,000 | 49,000 |
| Diene-monomer-containing resin 3 | 13 | 87 | 12,000 | 58,000 |

TABLE 2-continued

| | Compositional ratio in resin | | | |
|---|---|---|---|---|
| | Component derived from | Component derived from | Molecular weight distribution by GPC | |
| Resin | diene monomer | other monomer | Mn | Mw |
| Diene-monomer-containing resin 4 | 28 | 72 | 9,000 | 32,000 |
| Diene-monomer-containing resin 5 | 15 | 85 | 17,000 | 180,000 |

TABLE 3

| Resin | Molecular weight distribution by GPC Number-average molecular weight (Mn) |
|---|---|
| Diene-monomer-containing resin 6 | 1,900 |
| Diene-monomer-containing resin 7 | 2,000 |
| Diene-monomer-containing resin 8 | 9,000 |
| Diene-monomer-containing resin 9 | 10,000 |
| Diene-monomer-containing resin 10 | 11,000 |

TABLE 4

| | Toner 1 | Toner 2 | Comparative toner 1 | Comparative toner 2 |
|---|---|---|---|---|
| Diene-monomer-containing resin No. | 1 | 2 | 3 | 1 |
| Amount (pbw) | 10 | 10 | 0.1 | 10 |
| Resin No., used in combination | 1 | 2 | 1 | 1 |
| Amount (pbw) | 100 | 100 | 100 | 100 |
| Carbon black: (pbw) | 10 | 10 | 10 | 10 |
| Charge control agent | II | III | II | II |
| Amount (pbw) | 2 | 2 | 2 | 2 |
| Low-molecular weight polyethylene: (pbw) | 5 | 5 | 5 | 5 |
| Polymerization initiator added at the time of surface cross-linking | t-Butyl peroxyneo-decanoate | Potassium persulfate | Potassium persulfate | None |
| Amount (pbw) | 0.7 | 1.0 | 0.5 | — |
| Ion-exchanged water added at the time of addition of polymerization initiator (pbw) | 20 | 10 | 10 | None |

TABLE 5

| | Toner | | | | | | | | | |
|---|---|---|---|---|---|---|---|---|---|---|
| | 3 | 4 | 5 | 6 | 7 | 8 | 9 | 10 | 11 | 12 |
| Styrene (pbw) | 82 | 81 | 84 | 91 | 90 | 83 | 86 | 91 | 84 | 85 |
| 2-Ethylhexyl acrylate (pbw) | 18 | 19 | 16 | 9 | 10 | 17 | 14 | 9 | 16 | 15 |
| Diene-monomer-containing resin No. | 1 | 2 | 3 | 4 | 5 | 6 | 7 | 8 | 9 | 10 |
| Amount (pbw) | 10 | 0.55 | 20 | 50 | 75 | 10 | 2 | 30 | 50 | 30 |
| Carbon black: (pbw) | 10 | 10 | 10 | 10 | 10 | 10 | 10 | 10 | 10 | 10 |
| Charge control agent | II | III | II | II + III | II + III | III | II | II | III | III |
| Amount (pbw) | 2 | 1 | 1 | 0.5 + 0.5 | 0.5 + 0.5 | 2 | 1 | 1 | 1 | 1 |
| Ester wax: (pbw) | 7 | 7 | 4 | 7 | 7 | 7 | 4 | 7 | 4 | 7 |
| 2,2'-Azobis (2,4-dimethylvaleronitrile): (pbw) | 3 | 3 | 3 | 2 | 1 | 3 | 3 | 5 | 2 | 1 |
| Polymerization temperature: (° C.) | 70 | 70 | 70 | 60 | 60 | 70 | 70 | 70 | 70 | 60 |
| Polymerization initiator added at the time of surface cross-linking | PPS | PPS | SPS | APS | 2,2-Az | PPS | SPS | PPS | t-BPN | t-BPEH |
| Amount (pbw) | 0.4 | 0.5 | 2 | 1 | 1 | 0.05 | 1 | 2 | 1 | 1 |
| Ion-exchanged water added at the time of addition of polymerization initiator: (pbw) | 20 | 20 | 30 | 25 | 30 | 20 | 20 | 30 | 25 | 30 |
| Reaction temperature at the time of surface cross-linking: (° C.) | 70 | 75 | 80 | 80 | 85 | 75 | 75 | 80 | 75 | 80 |
| Conversion of polymerization at the time of addition of polymerization initiator: (%) | 43 | 65 | 86 | 14 | 50 | 70 | 28 | 86 | 14 | 50 |

PPS: Potassium persulfate
SPS: Sodium persulfate
APS: Ammonium persulfate
2,2'-Az: 2,2-Azobis-(2-aminodipropane)dihydrochloride
t-BPN: t-Butyl peroxyneodecanoate
t-BPEH: t-Butyl peroxy-2-ethylhexanoate

TABLE 6

| | Comparative toner 3 | Comparative toner 4 | Comparative toner 5 | Comparative toner 6 | Comparative toner 7 |
|---|---|---|---|---|---|
| Styrene: (pbw) | 86 | 88 | 84 | 91 | 82 |
| 2-Ethylhexyl acrylate: (pbw) | 14 | 12 | 16 | 9 | 18 |
| Diene-monomer-containing resin No. | 1 | 2 | 6 | 7 | Unsaturated polyester |
| Amount (pbw) | 0.1 | 10 | 35 | 10 | 10 |
| Carbon black: (pbw) | 10 | 10 | 10 | 10 | 10 |
| Charge control agent | III | II | II | II | II |
| Amount (pbw) | 2 | 1 | 1 | 1 | 1 |
| Ester wax: (pbw) | 7 | 4 | 7 | 7 | 7 |
| 2,2'-Azobis (2,4-dimethylvaleronitrile): (pbw) | 3 | 1 | 5 | 1 | 3 |
| Polymerization temperature: (° C.) | 70 | 55 | 75 | 80 | 70 |
| Polymerization initiator added at the time of surface cross-linking | PPS | SPS | SPS | None | PPS |
| Amount (pbw) | 2 | 5 | 2 | — | 0.4 |
| Ion-exchanged water added at the time of addition of polymerization initiator: (pbw) | 20 | 30 | 30 | None | 40 |
| Reaction temperature at the time of surface cross-linking (° C.) | 75 | 70 | 75 | — | 70 |
| Conversion of polymerization at the time of addition of polymerization initiator: (%) | 45 | 37 | 61 | — | — |

PPS: Potassium persulfate
SPS: Sodium persulfate

TABLE 7

| | Diene monomer content in toner (wt. %) | Glass transition temp. Tg (° C.) | Toner's BET specific surface area (A) | (B) | (B/A) | Circularity corr. average particle diam. (μm) | Average circularity | Circularity standard deviation | Toner with circularity smaller than 0.950 (no. %) | Main peak molecular weight | THF insoluble matter (wt. %) |
|---|---|---|---|---|---|---|---|---|---|---|---|
| Toner | | | | | | | | | | | |
| 1 | 1.6 | 55 | 2.8 | 2.5 | 0.89 | 5.3 | 0.953 | 0.039 | 28 | 11,000 | 25 |
| 2 | 1.8 | 53 | 2.5 | 2.6 | 1.04 | 7.8 | 0.968 | 0.033 | 25 | 14,000 | 28 |
| Comparative Toner | | | | | | | | | | | |
| 1 | 0.01 | 55 | 2.5 | 1.9 | 0.76 | 7.3 | 0.948 | 0.041 | 31 | 12,000 | 8 |
| 2 | 1.6 | 54 | 3.1 | 2.4 | 0.77 | 4.2 | 0.950 | 0.039 | 29 | 10,000 | 22 |
| Toner | | | | | | | | | | | |
| 3 | 1.5 | 44 | 2.8 | 2.4 | 0.86 | 5.5 | 0.989 | 0.021 | 3 | 26,000 | 23 |
| 4 | 0.1 | 41 | 2.4 | 2.1 | 0.88 | 9.2 | 0.981 | 0.024 | 5 | 28,000 | 6 |
| 5 | 1.8 | 49 | 2.5 | 2.4 | 0.96 | 7.4 | 0.992 | 0.019 | 2 | 20,000 | 20 |
| 6 | 8.1 | 65 | 2.7 | 2.3 | 0.85 | 5.9 | 0.972 | 0.031 | 11 | 31,000 | 39 |
| 7 | 5.7 | 67 | 3.0 | 2.5 | 0.83 | 4.3 | 0.984 | 0.022 | 7 | 52,000 | 31 |
| 8 | 7.5 | 47 | 2.6 | 2.3 | 0.88 | 6.4 | 0.981 | 0.026 | 8 | 38,000 | 32 |
| 9 | 1.4 | 55 | 2.7 | 2.4 | 0.89 | 6.1 | 0.990 | 0.020 | 3 | 24,000 | 22 |
| 10 | 19.2 | 68 | 2.6 | 2.3 | 0.88 | 7.0 | 0.969 | 0.033 | 17 | 10,000 | 35 |
| 11 | 8.9 | 69 | 2.5 | 2.3 | 0.92 | 8.4 | 0.976 | 0.027 | 9 | 29,000 | 21 |
| 12 | 5.3 | 52 | 2.6 | 2.6 | 1.00 | 6.9 | 0.980 | 0.026 | 12 | 48,000 | 53 |
| Comparative Toner | | | | | | | | | | | |
| 3 | 0.08 | 55 | 2.7 | 2.0 | 0.74 | 6.3 | 0.981 | 0.027 | 8 | 22,000 | 13 |
| 4 | 1.9 | 61 | 2.8 | 2.4 | 0.86 | 5.2 | 0.971 | 0.032 | 19 | 105,000 | 44 |
| 5 | 21.7 | 70 | 2.5 | 2.1 | 0.84 | 7.4 | 0.949 | 0.034 | 20 | 17,000 | 56 |
| 6 | 2.3 | 49 | 2.5 | 1.8 | 0.75 | 9.3 | 0.984 | 0.024 | 6 | 33,000 | 32 |
| 7 | 0 | 63 | 2.4 | 2.3 | 0.96 | 5.8 | 0.975 | 0.031 | 14 | 30,000 | 43 |

TABLE 8

| | Normal temp./normal humidity | | | | | Low temp./normal humidity | | | | | High temp./normal humidity | | | | |
|---|---|---|---|---|---|---|---|---|---|---|---|---|---|---|---|
| | Image density | Fog | Half-tone image uni-formity | Fixing perfor-mance | Anti-offset pro-perties | Image density | Fog | Half-tone image uni-formity | Fixing perfor-mance | Anti-offset pro-perties | Image density | Fog | Half-tone image uni-formity | Fixing perfor-mance | Anti-offset pro-perties |
| Toner | | | | | | | | | | | | | | | |
| 1 | A | B | B | B | B | B | C | C | C | B | A | A | B | B | B |
| 2 | A | B | B | B | B | B | C | C | C | B | A | B | B | B | C |
| Comparative Toner | | | | | | | | | | | | | | | |
| 1 | A | B | B | C | B | C | C | C | C | B | B | B | C | B | D |
| 2 | A | B | B | C | B | B | C | C | C | B | B | B | C | B | C |
| Toner | | | | | | | | | | | | | | | |
| 3 | A | A | A | A | B | B | B | A | B | B | A | A | A | A | B |
| 4 | A | A | A | B | B | B | B | A | B | B | A | A | B | A | |
| 5 | A | A | A | A | A | A | A | A | A | A | A | A | A | A | A |
| 6 | A | A | A | B | A | B | A | A | C | A | A | A | A | B | A |
| 7 | A | A | A | B | A | A | A | A | C | A | A | A | A | A | A |
| 8 | A | A | A | B | A | B | B | A | B | A | A | A | B | B | A |
| 9 | A | A | A | A | A | A | A | A | A | A | A | A | A | A | A |
| 10 | A | A | A | A | B | A | A | A | A | A | A | B | B | A | C |
| 11 | A | A | A | A | A | B | B | B | A | B | A | A | B | B | A |
| 12 | A | A | A | B | B | B | B | A | B | C | A | A | A | C | B |
| Comparative Toner | | | | | | | | | | | | | | | |
| 3 | A | B | B | B | B | B | B | C | B | B | A | B | C | B | B |
| 4 | A | A | A | C | C | B | B | A | D | C | A | A | A | C | C |
| 5 | A | A | B | B | B | B | B | B | D | B | A | B | B | C | C |

TABLE 8-continued

| | Normal temp./normal humidity | | | | | Low temp./normal humidity | | | | | High temp./normal humidity | | | | |
|---|---|---|---|---|---|---|---|---|---|---|---|---|---|---|---|
| | Image density | Fog | Half-tone image uni-formity | Fixing perfor-mance | Anti-offset pro-perties | Image density | Fog | Half-tone image uni-formity | Fixing perfor-mance | Anti-offset pro-perties | Image density | Fog | Half-tone image uni-formity | Fixing perfor-mance | Anti-offset pro-perties |
| 6 | A | A | A | A | B | B | B | B | D | B | A | A | A | B | C |
| 7 | A | A | A | D | A | B | C | C | D | A | A | A | A | C | C |

TABLE 9

| | Toner contamination & melt-adhesion | | | Evaluation on toner | | | |
|---|---|---|---|---|---|---|---|
| | Charging roller | Photosensitive member | Developing sleeve | Transfer performance | Dot repro-ducibility | Anti-offset properties | Fog |
| Toner | | | | | | | |
| 3 | A | B | B | A | A | B | B |
| 4 | A | A | B | B | A | B | C |
| 5 | A | A | A | A | A | A | A |
| 6 | A | B | B | B | B | A | A |
| 7 | A | B | C | A | A | A | A |
| 8 | A | B | A | A | A | A | B |
| 9 | A | A | B | A | A | A | A |
| 10 | B | B | B | A | B | A | A |
| 11 | B | A | A | B | B | B | B |
| 12 | A | A | A | A | A | B | B |
| Comparative Toner | | | | | | | |
| 3 | C | C | C | B | B | B | B |
| 4 | B | B | B | B | B | C | B |
| 5 | B | C | C | C | C | B | B |
| 6 | B | C | C | A | B | B | B |
| 7 | B | C | C | A | C | B | B |

TABLE 10

| | Toner contamination & melt-adhesion | | | | Evaluation on toner | | | |
|---|---|---|---|---|---|---|---|---|
| | Charging roller | Intermediate transfer belt | Photo-sensitive member | Developing sleeve | Transfer performance | Dot repro-ducibility | Anti-offset properties | Fog |
| Toner 5 | A | A | A | A | A | A | A | A |
| Comparative Toner 6 | B | B | C | C | B | B | B | B |

What is claimed is:

1. A dry toner comprising toner particles containing at least a binder resin, a colorant and a wax component, and an external additive, wherein;

(1) the binder resin contains a component formed from a monomer selected from the group consisting of butadiene, isoprene and chloroprene;

(2) said toner has a main glass transition temperature (Tg) of from 40° C. to 70° C. as measured by differential scanning calorimetry (DSC);

(3) where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$), the toner satisfies the following relationship:

$$0.8 \leqq A \leqq 4.0,\ 0.80 \leqq (B/A) \leqq 1.05;$$

(4) in a toner's number-based circle-corresponding diameter/circularity scatter diagram as measured with a flow particle image analyzer, the toner has a circle-corresponding number-average particle diameter D1 of from 2 μm to 10 μm and has an average circularity of from 0.950 to 0.995 and a circularity standard deviation of less than 0.040; and (5) the toner has, in its molecular-weight distribution of tetrahydrofuran (THF)-soluble matter as measured by gel permeation chromatography (GPC), a main-peak molecular weight in the region of from 2,000 to 100,000 and contains a THF-insoluble matter in an amount of from 5% by weight to 60% by weight.

2. The toner according to claim 1, wherein at least one of the butadiene, isoprene and chloroprene contained in said binder resin is in a content of from 0.1% by weight to 20% by weight in total, based on the weight of the toner.

3. The toner according to claim 1, wherein at least one of the butadiene, isoprene and chloroprene contained in said binder resin is in a content of from 0.1% by weight to 10% by weight in total, based on the weight of the toner.

4. The toner according to claim 1, wherein said binder resin comprises a copolymer of at least one of styrene, o-methylstyrene, m-methylstyrene, p-methylstyrene, m-ethylstyrene or p-ethylstyrene with butadiene.

5. The toner according to claim 1, which further comprises a charge control agent represented by the following Formula (I)

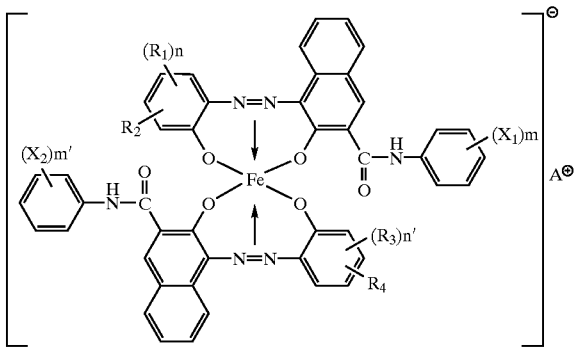

wherein $X_1$ and $X_2$ each represent a hydrogen atom, an alkyl group having 1 to 10 carbon atoms, an alkoxyl group having 1 to 10 carbon atoms, a nitro group or a halogen atom, $X_1$ and $X_2$ are the same or different, and m and m' each represent an integer of 1 to 3; $R_1$ and $R_3$ each represent a hydrogen atom, an alkyl group having 1 to 18 carbon atoms, an alkenyl group having 1 to 18 carbon atoms, a sulfonamide group, a mesyl group, a sulfonyl group, a hydroxyl group, an alkoxyl group having 1 to 18 carbon atoms, an acetylamino group, a benzoylamino group, a halogen atom or —$COOR_5$, $R_1$ and $R_3$ are the same or different, and n and n' each represent an integer of 1 to 3; $R_2$and $R_4$ each represent a hydrogen atom or a nitro group; $R_5$ represents an alkyl group or an aryl group; and $A^+$ represents a hydrogen ion, a sodium ion, a potassium ion or an ammonium ion.

6. The toner according to claim 1, wherein the average circularity of the toner is from 0.970 to 0.995.

7. The toner according to claim 1, wherein the average circularity of the toner is from 0.970 to 0.995 and the circularity standard deviation thereof is less than 0.035.

8. The toner according to claim 1, wherein toner particles having, in the toner's number-based circle-corresponding diameter/circularity scatter diagram, an average circularity less than 0.950 are in a content of 15% by number or less.

9. The toner according to claim 1, wherein said binder resin contains a styrene-acrylic resin in an amount of from 50% by weight to 99.9% by weight.

10. The toner according to claim 1, wherein said binder resin contains a styrene-acrylic resin in an amount of from 80% by weight to 99.9% by weight.

11. The toner according to claim 1, wherein said binder resin contains a styrene-acrylic resin in an amount of from 85% by weight to 98% by weight.

12. The toner according to claim 1, wherein said external additive is a fine silica powder.

13. The toner according to claim 12, wherein said fine silica powder has a BET specific surface area of 30 $m^2/g$ or larger.

14. The toner according to claim 12, wherein said fine silica powder has a BET specific surface area of from 50 $m^2/g$ to 400 $m^2/g$.

15. The toner according to claim 1, which, where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$), satisfies the following relationship:

$$0.8 \leqq A \leqq 4.0,\ 0.90 \leqq (B/A) \leqq 1.05.$$

16. The toner according to claim 1, which has, in its molecular-weight distribution of tetrahydrofuran(THF)-soluble matter as measured by gel permeation chromatography (GPC), a main-peak molecular weight in the region of from 5,000 to 50,000.

17. The toner according to claim 1, which contains the THF-insoluble matter in an amount of from 5% by weight to 55% by weight.

18. An image forming method comprising:

a charging step of applying a voltage to a charging member to charge an electrostatic latent image bearing member;

an electrostatic latent image forming step of forming an electrostatic latent image on the electrostatic latent image bearing member thus charged;

a developing step of bringing a toner carried on a toner-carrying member into adhesion to the electrostatic latent image formed on the electrostatic latent image bearing member, to form a toner image on the electrostatic latent image bearing member;

a transfer step of electrostatically transferring the toner image formed on the electrostatic latent image bearing member, to a transfer medium via, or not via, an intermediate transfer member; and a fixing step of fixing the toner image transferred electrostatically to the transfer medium;

said toner being a dry toner comprising toner particles containing at least a binder resin, a colorant and a wax component, and an external additive, wherein;

(1) said binder resin contains a component formed from a monomer selected from the group consisting of butadiene, isoprene and chloropene;

(2) said toner has a main glass transition temperature (Tg) of from 40° C. to 70° C. as measured by differential scanning calorimetry (DSC);

(3) where specific surface area measured by the BET method when the toner is left for 72 hours in an environment of 23° C. atmospheric temperature and 65% relative humidity is represented by A ($m^2/g$) and specific surface area measured by the BET method when the toner is left for 72 hours in an environment of 50° C. atmospheric temperature and 3% relative humidity is represented by B ($m^2/g$), the toner satisfies the following relationship:

$$0.8 \leqq A \leqq 4.0,\ 0.80 \leqq (B/A) \leqq 1.05;$$

(4) in a toner's number-based circle-corresponding diameter/circularity scatter diagram as measured with a flow particle image analyzer, said toner has a circle-corresponding number-average particle diameter Dl of from 2 $\mu$m to 10 $\mu$m and has an average circularity of from 0.950 to 0.995 and a circularity standard deviation of less than 0.040; and (5) said toner has, in its molecular-weight distribution of tetrahydrofuran (THF)-soluble matter as measured by gel permeation chromatography (GPC), a main-peak molecular weight in the region of from 2,000 to 100,000 and contains a THF-insoluble matter in an amount of from 5% by weight to 60% by weight.

19. The image-forming method according to claim 18, wherein in said developing step the surface movement speed of said toner-carrying member at a developing zone is a speed from 1.05 to 3.0 times the surface movement speed of said electrostatic latent image bearing member.

20. The image-forming method according to claim 18, wherein a toner layer thickness on said toner-carrying member is regulated by a regulation member, and the regulation member is a ferromagnetic metal blade.

21. The image-forming method according to claim 20, wherein said regulation member is provided to face said toner-carrying member, leaving a stated distance.

22. The image-forming method according to claim 18, wherein a toner layer thickness on said toner-carrying member is regulated by a regulation member, and the regulation member is a blade comprising an elastic member.

23. The image-forming method according to claim 22, wherein said blade comprising an elastic member is face to face provided in contact with said toner-carrying member.

24. The image-forming method according to claim 18, wherein in said developing step said electrostatic latent image bearing member and said toner-carrying member are provided to have a stated distance between them, and the development is performed under formation of an alternating electric field across the both.

25. The image-forming method according to claim 18, wherein in said developing step the development is performed while the electrostatic latent image formed on said electrostatic latent image bearing member and said toner, which has been coated in thin layer on said toner-carrying member, are brought into contact with each other.

26. The image-forming method according to claim 18, wherein in said charging step said charging member is brought into contact with said electrostatic latent image bearing member to charge said electrostatic latent image bearing member.

27. The image-forming method according to claim 18, wherein in said transfer step said electrostatic latent image bearing member and a transfer assembly is in contact via said transfer medium.

28. The image-forming method according to claim 18, wherein said fixing step is a heat fixing step of fixing the toner image onto said transfer medium by heat.

29. The image-forming method according to claim 28, wherein said heat fixing step is the step of fixing the toner onto said transfer medium by heat and pressure by a heating member and a pressure member coming into pressure contact with the heating member.

30. The image-forming method according to claim 29, wherein in said heat fixing step a film is interposed between said transfer medium and said heating member.

31. The image-forming method according to claim 18, which further comprises, after said transfer step, a cleaning-at-development step of collecting a transfer residual toner remaining on said electrostatic latent image bearing member, in said developing step through said toner-carrying member.

* * * * *